US008976972B2

(12) United States Patent
Emerit et al.

(10) Patent No.: US 8,976,972 B2
(45) Date of Patent: Mar. 10, 2015

(54) PROCESSING OF SOUND DATA ENCODED IN A SUB-BAND DOMAIN

(75) Inventors: Marc Emerit, Rennes (FR); Rozenn Nicol, La Roche Derrien (FR); Grégory Pallone, Trelevern (FR)

(73) Assignee: Orange, Paris (FR)

( * ) Notice: Subject to any disclaimer, the term of this patent is extended or adjusted under 35 U.S.C. 154(b) by 400 days.

(21) Appl. No.: 13/500,955

(22) PCT Filed: Oct. 8, 2010

(86) PCT No.: PCT/FR2010/052119
§ 371 (c)(1),
(2), (4) Date: Apr. 9, 2012

(87) PCT Pub. No.: WO2011/045506
PCT Pub. Date: Apr. 21, 2011

(65) Prior Publication Data

US 2012/0201389 A1 Aug. 9, 2012

(30) Foreign Application Priority Data

Oct. 12, 2009 (FR) ..... 09 57118

(51) Int. Cl.
*H04R 5/00* (2006.01)
*H04S 1/00* (2006.01)
*G10L 19/008* (2013.01)

(52) U.S. Cl.
CPC ..... *H04S 1/002* (2013.01); *G10L 19/008* (2013.01); *H04S 2420/01* (2013.01)
USPC ..... 381/23; 381/300; 381/307; 381/310

(58) Field of Classification Search
None
See application file for complete search history.

(56) References Cited

U.S. PATENT DOCUMENTS

| | | | | |
|---|---|---|---|---|
| 5,982,903 | A * | 11/1999 | Kinoshita et al. | 381/18 |
| 6,442,277 | B1 * | 8/2002 | Lueck et al. | 381/17 |
| 6,931,291 | B1 * | 8/2005 | Alvarez-Tinoco et al. | 700/94 |
| 7,505,601 | B1 | 3/2009 | Brungart | |
| 8,321,214 | B2 * | 11/2012 | Chan et al. | 704/225 |
| 2009/0043591 | A1 * | 2/2009 | Breebaart et al. | 704/500 |
| 2009/0060205 | A1 * | 3/2009 | Jung et al. | 381/1 |
| 2009/0245529 | A1 * | 10/2009 | Asada et al. | 381/71.6 |

OTHER PUBLICATIONS

ISO/IEC, "Information technology—MPEG audio technologies, MPEG Surround," ISO/EIC 23003-1:2006/FDIS, ITU Study Group 16, Video Coding Experts Group—ISO/IEC MPEG & ITU-T VCEG (ISO/IEC JTC1/SC29/WG11 and ITU-T SG16 Q6), No. N8324, pp. 1-283 (Jul. 21, 2006).

* cited by examiner

*Primary Examiner* — Duc Nguyen
*Assistant Examiner* — Assad Mohammed
(74) *Attorney, Agent, or Firm* — Drinker Biddle & Reath LLP

(57) ABSTRACT

Processing of sound data encoded in a sub-band domain, for dual-channel playback of binaural or Transaural® type is provided, in which a matrix filtering is applied so as to pass from a sound representation with N channels with N>0, to a dual-channel representation. This sound representation with N channels comprises considering N virtual loudspeakers surrounding the head of a listener, and, for each virtual loudspeaker of at least some of the loudspeakers: a first transfer function specific to an ipsilateral path from the loudspeaker to a first ear of the listener, facing the loudspeaker, and a second transfer function specific to a contralateral path from said loudspeaker to the second ear of the listener, masked from the loudspeaker by the listener's head. The matrix filtering comprises a multiplicative coefficient defined by the spectrum, in the sub-band domain, of the second transfer function deconvolved with the first transfer function.

13 Claims, 4 Drawing Sheets

FIG.4A.
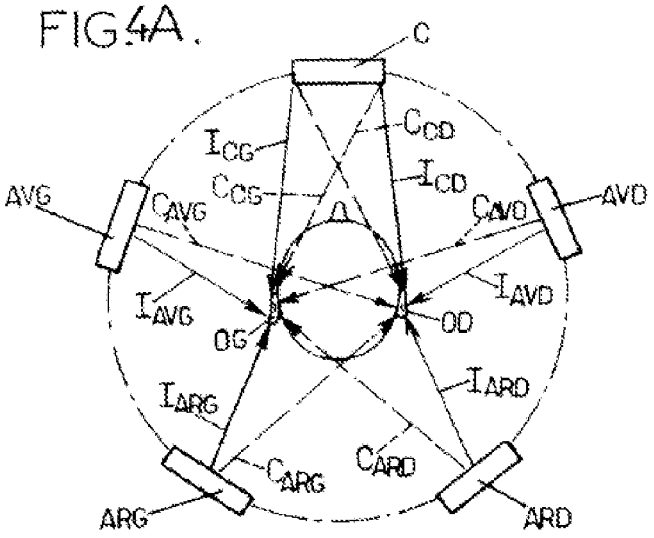
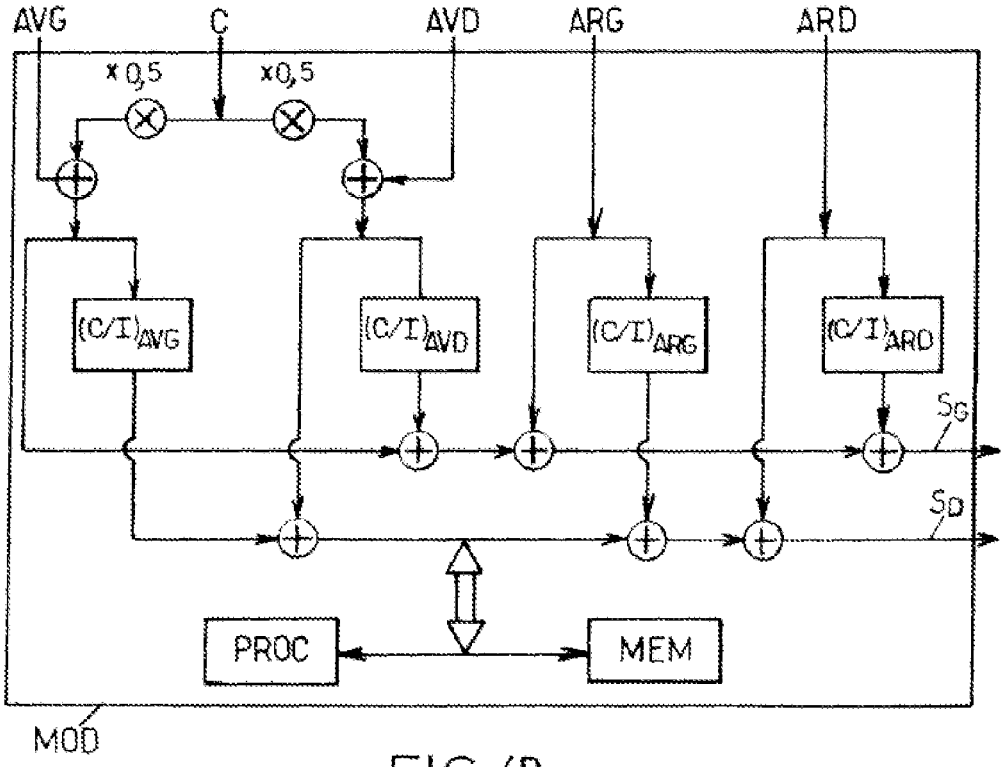
FIG.4B.

PROCESSING OF SOUND DATA ENCODED IN A SUB-BAND DOMAIN

CROSS-REFERENCE TO RELATED APPLICATIONS

This application is the U.S. national phase of the International Patent Application No. PCT/FR2010/052119 filed Oct. 8, 2010, which claims the benefit of French Application No. 09 57118 filed Oct. 12, 2009, the entire content of which is incorporated herein by reference.

FIELD OF THE INVENTION

The invention relates to a processing of sound data.

In the context of the processing of sound data in a multi-channel format (5.1 or more), it is sought to achieve a 3D spatialization effect called "Virtual Surround". Such processing procedures involve filters which are aimed at reproducing a sound field at the inputs of a person's auditory canals.

BACKGROUND

Indeed, a listener is capable of locating sounds in space with a certain precision, by virtue of the perception of sounds by his two ears. The signals emitted by the sound sources undergo acoustic transformations while propagating up to the ears. These acoustic transformations are characteristic of the acoustic channel that becomes established between a sound source and a point of the individual's auditory canal. Each ear possesses its own acoustic channel, and these acoustic channels depend on the position and the orientation of the source in relation to the listener, the shape of the head and the ear of the listener, and also the acoustic environment (for example reverberation due to a hall effect). These acoustic channels may be modeled by filters commonly called "Head Impulse Responses" or HRIR (for "Head Related Impulse Responses"), or else "Head transfer functions" or HRTF ("Head Related Transfer Functions") depending on whether a representation thereof is given in the time domain or frequency domain respectively.

With reference to FIG. 1 has been represented a "direct" pathway CD from a source HP1 to the (left) ear OG of the listener AU (viewed from above), this ear OG being situated directly facing the source HP1. Also represented is a "cross" pathway CC between a source HP2 and this same ear OG of the listener AU, the pathway CC passing through the head TET of the listener AU since the source HP2 is disposed on the other side of the mid-plane P with respect to the source HP2.

In an environment without reverberation (for example an anechoic chamber), considering that human faces are symmetric, the HRTF functions for the left ear and for the right ear (termed respectively "left HRTF" and "right HRTF" hereinafter) are identical for the sources which are situated in the mid-plane (plane P which separates the left half from the right half of the body as illustrated in FIG. 2). The acoustic indices utilized by the brain to locate the sounds are often classed into two families of indices:

- so-called "monaural" indices relating to the locating of a sound on the basis of a single ear, and
- so-called "interaural" indices relating to the locating of a sound by the brain by utilizing the differences between the signals perceived by the left ear and the right ear.

Known techniques for processing sound data in multi-channel format (for example with more than two loudspeakers) with a view to playback on two loudspeakers only, for example on a headset with a 3D spatialization effect, are described hereinafter.

The term "binaural playback" is then understood to denote listening on a headset to audio contents initially in the multi-channel format (for example in the 5.1 format, or other formats delivering more than two tracks), these audio contents being processed in particular with mixing of the channels so as to deliver only two signals feeding, in the so-called "binaural" configuration, the two mini loudspeakers (or "earpieces") of a conventional stereophonic headset). Thus, in the transformation from a "multi-channel" format to a "binaural" format, it is sought to offer quality of spatialization and immersion to the headset similar or equivalent to that obtained with a multi-channel playback system comprising as many remote loudspeakers as channels. Furthermore, the term "Transaural® playback" is understood to denote listening on two remote loudspeakers to audio contents initially in a multi-channel format.

Conventionally, for listening to an audio content in the 5.1 multi-channel format on a stereophonic headset or on a pair of loudspeakers, a matrixing of the channels, hereinafter called "sub-mixing" or "Downmix", is performed. A "Downmix" processing is a matrix processing which makes it possible to pass from N channels to M channels with N>M. It will be considered hereinafter that a "Downmix" processing (provided that it does not take account of spatialization effects) does not involve any filter based on HRTF functions. In general, the matrices of the "Downmix" processing used in sound playback devices (PC computer, DVD player, television, or the like) have constant coefficients which depend neither on time nor frequency. Recent "Downmix" processing procedures now exhibit matrices whose coefficients depend on time and frequency and are adjusted at each instant as a function of a time and frequency representation of the input signals. This type of matrix makes it possible for example to prevent the input signals from cancelling one another out by adding together. A constant-matrix version of a processing of "Downmix" type, termed "Downmix ITU", has been standardized by the International Telecommunications Union "ITU". This processing is applied by implementing the following equations:

$$S_G=E_{AVG}+E_c*0.707+E_{ARG}*0.707$$

$$S_R=E_{AVD}+E_c*0.707+E_{ARD}*0.707,$$

where:

- $S_G$ and $S_R$ are respectively left and right output stereo signals,
- $E_{AVG}$ and $E_{AVD}$ are respectively input signals which would have been intended to feed left AVG and right AVD lateral loudspeakers (illustrated in FIG. 2),
- $E_{ARG}$ and $E_{ARD}$ are respectively input signals which would have been intended to feed rear left ARG and rear right ARD loudspeakers, situated behind the listener AU of FIG. 2,
- $E_C$ is an input signal which would have been intended to feed a central loudspeaker C situated facing the listener AU, and
- 0.707 represents an approximation of the square root of ½.

It is possible to consider such gains as gains applied to the loudspeakers.

By way of example, the processing hereinafter termed "Downmix ITU" does not allow the accurate spatial perception of sound events. As indicated previously furthermore, a processing of "Downmix" type, generally, does not allow spatial perception since it does not involve any HRTF filter.

The feeling of immersion that the contents can offer in the multi-channel format is then lost with headset listening with respect to listening on a system with more than two loudspeakers (for example in the 5.1 format as illustrated in FIG. 2). By way of example, a sound assumed to be emitted by a mobile source from the front to the rear of the listener, is not played back correctly on a stereo-only system (on a headset with earpieces or a pair of loudspeakers). Furthermore, a sound present solely in the channel $S_G$ (or $S_R$) and processed by the "Downmix ITU" sub-mixing is played back only in the left (or right, respectively) earpiece in the case of headset listening, whereas in the case of listening on a system with more than two loudspeakers (for example in the 5.1 format), the right (or left, respectively) ear also perceives a signal by diffraction.

In order to alleviate these drawbacks, the method of sub-mixing to a binaural format, termed "Binaural downmix", has been developed. It consists in placing virtually five (or more) loudspeakers in a sound environment played back on two tracks only, as if five sources (or more) were to be spatialized for binaural playback. Thus, a content in the multi-channel format is broadcast on "virtual" loudspeakers in a context of binaural playback. The uses of such a technique currently lie mainly in DVD players (on PC computers, on televisions, on living-room DVD players, or the like), and soon on mobile terminals for playing televisual or video data.

In the "Binaural downmix" method, the virtual loudspeakers are created by the so-called "binaural synthesis" technique. This technique consists in applying head acoustic transfer functions (HRTF), to monophonic audio signals, so as to obtain a binaural signal which makes it possible, during headset listening, to have the sensation that the sound sources originate from a particular direction in space. The signal of the right ear is obtained by filtering the monophonic signal with the HRTF function of the right ear and the signal of the left ear is obtained by filtering this same monophonic signal with the HRTF function of the left ear. The resulting binaural signal is then available for headset listening.

This implementation is illustrated in FIG. 3A. A transfer function defined by a filter is associated with each acoustic pathway between an ear of the listener and a virtual loudspeaker (placed as advocated in the 5.1 multi-channel format in the example represented). Thus, with reference to FIG. 3B, for ten acoustic pathways in all:

- HCg (respectively HCd) is the filter corresponding to an HRTF for the pathway between the central loudspeaker C and the left OG (respectively right OD) ear of the listener,
- HGg (respectively HDd) is the filter corresponding to a so-called "ipsilateral" HRTF (ear "illuminated" by the loudspeaker) for the direct pathway (solid line) between the left lateral AVG (respectively right lateral AVD) loudspeaker and the left OG (respectively right OD) ear of the listener,
- HGd (respectively HDg) is the filter corresponding to a so-called "contralateral" HRTF (ear in "the shadow" of the head) for the indirect pathway (dashed lines) between the left lateral AVG (respectively right lateral AVD) loudspeaker and the right OD (respectively left OG) ear of the listener,
- HGSg (respectively HDSd) is the filter corresponding to an ipsilateral HRTF for the direct pathway (solid line) between the rear left ARG (respectively rear right ARD) loudspeaker and the left OG (respectively right OD) ear of the listener, and
- HGSd (respectively HDSg) is the filter corresponding to a contralateral HRTF for the indirect pathway (dashed line) between the rear left ARG (respectively rear right ARD) loudspeaker and the right OD (respectively left OG) ear of the listener.

A drawback of this technique is its complexity since it requires two binaural filters per virtual loudspeaker (an ipsilateral HRTF and a contralateral HRTF), therefore ten filters in all in the case of a 5.1 format.

The problem is made more acute when these transfer functions need to be manipulated in the course of various processing procedures such as those according to the MPEG standard and in particular the processing termed "MPEG Surround"®.

Indeed, with reference to point 6.1 1.4.2.2.2 of the document "*Information technology—MPEG audio technologies—Part* 1: *MPEG Surround*", ISO/IEC JTC 1/SC 29 (21 Jul. 2006), a matrix filtering is provided for, in the domain of the sub-bands m (also denoted κ(k) here), of the type:

$$H_1^{l,k} = \begin{bmatrix} h_{11}^{l,k} & h_{12}^{l,k} \\ h_{21}^{l,k} & h_{22}^{l,k} \end{bmatrix} = \begin{bmatrix} h_{L,L}^{l,\kappa(k)} & h_{L,R}^{l,\kappa(k)} & h_{L,C}^{l,\kappa(k)} \\ h_{R,L}^{l,\kappa(k)} & h_{R,R}^{l,\kappa(k)} & h_{R,C}^{l,\kappa(k)} \end{bmatrix} \cdot \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot w_{temp}^{l,\kappa(k)},$$

$$0 \le k < K,\ 0 \le l < L$$

in order to pass from two monophonic signals to stereophonic signals in binaural representation.

Indeed, this standard provides for an embodiment in which a multi-channel signal is transported in the form of a stereo mixing (downmix) and of spatialization parameters (denoted CLD for "Channel Level Difference", ICC for "Inter-Channel Coherence", and CPC for "Channel Prediction Coefficient"). These parameters make it possible in a first step to implement a processing for expanding the stereo mixing (or "downmix") to three signals L', R' and C. In a second step, they allow the expansion of the signals L', R' and C so as to obtain signals 5.1 (denoted L, Ls, R, Rs, C and LFE for "Low Frequency Effect"). In the binaural mode, the signals C and LFE are not separate. The signal C is used for the Binaural downmix processing.

Therefore here, three signals (for respective left L', right R' and center C' channels) are firstly constructed on the basis of two monophonic signals. Thus, the notation $W_{temp}^{l,m}$; designates a processing matrix for expanding stereo signals to these three channels.

The subsequent processing procedures are thereafter:

- a processing for expanding these three channels to N channels in the multi-channel configuration, for example 5 channels in the 5.1 format, and
- a processing for spatializing N virtual loudspeakers respectively associated with these N channels so as to obtain a binaural or Transaural®, dual-channel representation, with:

$h_{L,C}^{l,m} = P_{L,C}^{m} \cdot e^{+j\Phi c^{m}/2}$, for the path from a central loudspeaker associated with the aforementioned channel C to the left ear, $h_{R,C}^{l,m} = P_{R,C}^{m} \cdot e^{-j\Phi c^{m}/2}$, for the path from the loudspeaker associated with the central C to the right ear, $$h_{L,L}^{l,m} = \sqrt{\left(\sigma_L^{l,m}\right)^2 (P_{L,L}^m)^2 + \left(\sigma_{LS}^{l,m}\right)^2 (P_{L,LS}^m)^2},$$

for the ipsilateral paths to the left ear, $$h_{R,L}^{l,m} = e^{-j(w_L^{l,m} d_L^m + w_{Ls}^{l,m} d_{Ls}^m)} \sqrt{\left(\sigma_L^{l,m}\right)^2 (P_{R,L}^m)^2 + \left(\sigma_{Ls}^{l,m}\right)^2 (P_{R,Ls}^m)^2},$$

for the contralateral paths to the left ear, $$h_{L,R}^{l,m} = e^{j(w_R^{l,m} d_R^m + w_{Rs}^{l,m} d_{Rs}^m)} \sqrt{(\sigma_R^{l,m})^2 (P_{L,R}^m)^2 + (\sigma_{Rs}^{l,m})^2 (P_{L,Rs}^m)^2},$$

for the contralateral paths to the right ear, $$h_{R,R}^{l,m} = \sqrt{(\sigma_R^{l,m})^2 (P_{R,R}^m)^2 + (\sigma_{Rs}^{l,m})^2 (P_{R,Rs}^m)^2},$$

for the ipsilateral paths to the right ear, where:

$\sigma_L^{l,m}$ and $\sigma_{Ls}^{l,m}$ represent relative gains to be applied to the signal of the channel L' so as to define channels L and Ls respectively of the left direct and left ambience virtual loudspeakers in the 5.1 format, for sample l of frequency band m in time-frequency transform, $\sigma_R^{l,m}$ or $\sigma_{Rs}^{l,m}$ relative gains to be applied to the signal of the channel R' to define channels R and Rs of the right direct and right ambience virtual loudspeakers in the 5.1 format, for sample l of frequency band m in time-frequency transform, $\phi_L^m$, $\phi_{Ls}^m$, $\phi_R^m$ and $\phi_{Rs}^m$ are phase shifts corresponding to interaural delays, and $w_L^{l,m}$, $w_{Ls}^{l,m}$, $w_R^{l,m}$ and $w_{Rs}^{l,m}$ are weightings such that:

$$w_L^{l,m} = \frac{(\sigma_L^{l,m})^2 (P_{R,L}^m)^2}{(\sigma_L^{l,m})^2 (P_{R,L}^m)^2 + (\sigma_{Ls}^{l,m})^2 (P_{R,Ls}^m)^2},$$

$$w_{Ls}^{l,m} = \frac{(\sigma_{Ls}^{l,m})^2 (P_{R,Ls}^m)^2}{(\sigma_L^{l,m})^2 (P_{R,L}^m)^2 + (\sigma_{Ls}^{l,m})^2 (P_{R,Ls}^m)^2},$$

$$w_R^{l,m} = \frac{(\sigma_R^{l,m})^2 (P_{L,R}^m)^2}{(\sigma_R^{l,m})^2 (P_{L,R}^m)^2 + (\sigma_{Rs}^{l,m})^2 (P_{L,Rs}^m)^2},$$

$$w_{Rs}^{l,m} = \frac{(\sigma_{Rs}^{l,m})^2 (P_{L,Rs}^m)^2}{(\sigma_R^{l,m})^2 (P_{L,R}^m)^2 + (\sigma_{Rs}^{l,m})^2 (P_{L,Rs}^m)^2}.$$

The following in particular will be adopted:

$P_{L,C}^m$ is the expression for the spectrum of the transfer function of HRTF type for a path between a central loudspeaker in the 5.1 format and the left ear of a listener, $P_{R,C}^m$ is the expression for the spectrum of the transfer function of HRTF type for a path between a central loudspeaker in the 5.1 format and the right ear of a listener, $P_{L,Ls}^m$ is the expression for the spectrum of the HRTF for a path between a left ambience loudspeaker in the 5.1 format and the left ear, $P_{R,Ls}^m$ is the expression for the spectrum of the HRTF for a path between a left ambience loudspeaker in the 5.1 format and the right ear, $P_{L,Rs}^m$ is the expression for the spectrum of the HRTF for a path between a right ambience loudspeaker in the 5.1 format and the left ear, $P_{R,Rs}^m$ is the expression for the spectrum of the HRTF for a path between a right ambience loudspeaker in the 5.1 format and the right ear, $P_{L,R}^m$ is the expression for the spectrum of the HRTF for a path between a right loudspeaker in the 5.1 format and the left ear, and $P_{R,R}^m$ is the expression for the spectrum of the HRTF for a path between a right loudspeaker in the 5.1 format and the right ear, $P_{L,L}^m$ is the expression for the spectrum of the HRTF for a path between a left loudspeaker in the 5.1 format and the left ear, and $P_{R,L}^m$ is the expression for the spectrum of the HRTF for a path between a left loudspeaker in the 5.1 format and the right ear.

In this example, there are thus ten filters associated with the aforementioned HRTF transfer functions for passing from the 5.1 format to a binaural representation. Hence the complexity problem posed by this technique, requiring two binaural filters per virtual loudspeaker (an ipsilateral HRTF and a contralateral HRTF).

SUMMARY

The present invention aims to improve the situation.

For this purpose, it proposes firstly a method for processing sound data encoded in a sub-band domain, for dual-channel playback of binaural or Transaural® type, in which a matrix filtering is applied so as to pass from a sound representation with N channels with N>0, to a dual-channel representation, this sound representation with N channels consisting in considering N virtual loudspeakers surrounding the head of a listener, and, for each virtual loudspeaker of at least some of the loudspeakers:

a first transfer function specific to an ipsilateral path from the loudspeaker to a first ear of the listener, facing the loudspeaker, and a second transfer function specific to a contralateral path from said loudspeaker to the second ear of the listener, masked from the loudspeaker by the listener's head.

Advantageously, the matrix filtering applied comprises a multiplicative coefficient defined by the spectrum, in the sub-band domain, of the second transfer function deconvolved with the first transfer function.

A first advantage which ensues from such a construction is the significant reduction in the complexity of the processing procedures. Already, as will be seen in detail further on, the transfer functions of the central virtual loudspeaker no longer need to be taken into account. Thus, it is not necessary to take into account the transfer functions of all the virtual loudspeakers, but of only some of the virtual loudspeakers.

Another simplification which ensues from the construction within the meaning of the invention is that it is no longer necessary to provide for a transfer function for the ipsilateral paths. For example, in the case of a matrix filtering to pass from a sound representation with M channels, with M>0, to a dual-channel representation (binaural or transaural), by passing through an intermediate representation on the N channels, with N>2, as in the case of the standard described hereinabove, the coefficients of the matrix are expressed, for a contralateral path, in particular as a function of respective spatialization gains of the M channels on the N virtual loudspeakers situated in a hemisphere around a first ear, and of the spectra of the contralateral transfer function, relating to the second ear of the listener, deconvolved with the ipsilateral transfer function, relating to the first ear. However, in an advantageous manner, for an ipsilateral path, the coefficients of the matrix are no longer expressed as a function of the spectra of HRTFs but simply as a function of spatialization gains of the M channels on the N virtual loudspeakers situated in a hemisphere around a first ear.

Thus, if the representation with N channels comprises, per hemisphere around an ear, at least one direct virtual loudspeaker and one ambience virtual loudspeaker as in "virtual surround", the coefficients of the matrix being expressed, in a sub-band domain as time-frequency transform (for example of "PQMF" type for "Pseudo-Quadrature Mirror Filters"), by:

$$h_{L,C}^{l,m}=g(1+P_{L,R}^{m}\cdot e^{-j\phi_R^m})$$

$$h_{R,C}^{l,m}=g(1+P_{R,L}^{m}\cdot e^{-j\phi_L^m})$$

If the HRTF functions are symmetric we have $h_{L,C}^{l,m}=h_{R,C}^{l,m}$ $$h_{L,R}^{l,m}=e^{j(w_R^{l,m}\phi_R^m+w_{Rs}^{l,m}\phi_{Rs}^m)}\sqrt{(\sigma_R^{l,m})^2(P_{L,R}^m)^2+(\sigma_{Rs}^{l,m})^2(P_{L,Rs}^m)^2},$$

for the contralateral paths to the left ear;

$$h_{R,L}^{l,m}=e^{-j(w_L^{l,m}\phi_L^m+w_{Ls}^{l,m}\phi_{Ls}^m)}\sqrt{(\sigma_L^{l,m})^2(P_{R,L}^m)^2+(\sigma_{Ls}^{l,m})^2(P_{R,Ls}^m)^2},$$

for the contralateral paths to the right ear;

$h_{L,L}^{l,m}=\sqrt{(\sigma_L^{l,m})^2+(\sigma_{Ls}^{lm})^2}$ only, for the ipsilateral paths to the left ear;

$h_{R,R}^{l,m}=\sqrt{(\sigma_R^{l,m})^2+(\sigma_{Rs}^{lm})^2}$ only, for the ipsilateral paths to the right ear, where:

$\sigma_L^{l,m}$ and $\sigma_{Ls}^{l,m}$ represent relative gains to be applied to one and the same first signal (for example the signal of the channel L' in an initial configuration with three channels, as described hereinabove) so as to define channels L and Ls respectively of the left direct and left ambience virtual loudspeakers, for sample l of frequency band m in time-frequency transform, $\sigma_R^{l,m}$ or $\sigma_{Rs}^{l,m}$ represent relative gains to be applied to one and the same second signal (for example the channel R') so as to define channels R and Rs of the right direct and right ambience virtual loudspeakers, for sample l of frequency band m in time-frequency transform, $P_{R,L}^m$ or $P_{R,Ls}^m$ is the expression for the spectrum of the transfer function of contralateral HRTF type, relating to the right ear of the listener, deconvolved with an ipsilateral transfer function, relating to the left ear, for a direct or respectively ambience, left virtual loudspeaker, $P_{L,R}^m$ or $P_{L,Rs}^m$ is the expression for the spectrum of the transfer function of contralateral HRTF type, relating to the left ear of the listener, deconvolved with an ipsilateral transfer function, relating to the right ear, for a direct or respectively ambience, right virtual loudspeaker, $\phi_L^m$, $\phi_{Ls}^m$, $\phi_R^m$ and $\phi_{Rs}^m$ are phase shifts between contralateral and ipsilateral transfer functions corresponding to chosen interaural delays, and $w_L^{l,m}$, $w_{Ls}^{l,m}$, $w_R^{l,m}$ and $w_{Rs}^{l,m}$ are chosen weightings.

Typically, the coefficient g can have an advantageous value of 0.707 (corresponding to the root of ½, when provision is made for an energy apportionment of half of the signal of the central loudspeaker on the lateral loudspeakers), as advocated in the "Downmix ITU" processing.

More precisely, through the implementation of the invention, the matrix filtering is expressed according to a product of matrices of type:

$$H_1^{l,k}=\begin{bmatrix} h_{11}^{l,k} & h_{12}^{l,k} \\ h_{21}^{l,k} & h_{22}^{l,k} \end{bmatrix}=\begin{bmatrix} h_{L,L}^{l,\kappa(k)} & h_{L,R}^{l,\kappa(k)} & h_{L,C}^{l,\kappa(k)} \\ h_{R,L}^{l,\kappa(k)} & h_{R,R}^{l,\kappa(k)} & h_{R,C}^{l,\kappa(k)} \end{bmatrix}\cdot\begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix}\cdot W_{temp}^{l,\kappa(k)},$$

$$0\le k<K,\ 0\le l<L,$$

where:

$W^{l,m}$ represents the processing matrix for expanding stereo signals to M' channels, with M'>2 (for example M'=3), and $$\begin{bmatrix} h_{L,L}^{l,\kappa(k)} & h_{L,R}^{l,\kappa(k)} & h_{L,C}^{l,\kappa(k)} \\ h_{R,L}^{l,\kappa(k)} & h_{R,R}^{l,\kappa(k)} & h_{R,C}^{l,\kappa(k)} \end{bmatrix}\cdot\begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix}$$

represents a global matrix processing comprising:

a processing for expanding M' channels to the N channels, with N>3 (for example 5, for a 5.1 format), and a processing for spatializing the N virtual loudspeakers respectively associated with the N channels so as to obtain a binaural or Transaural®, dual-channel representation.

Another drawback of the "Binaural downmix" method within the meaning of the prior art is that it does not retain the timbre of the initial sound, which is played back well by the "Downmix" processing, since the filters of the binaural processing resulting from the HRTFs greatly modify the spectrum of the signals and thus achieve "coloration" effects by comparison with "Downmix". Moreover, the great majority of users prefer "Downmix" even if "Binaural downmix" actually affords an extra-cranial spatial perception of sounds. The drawback of the impairment of timbre (or "coloration") afforded by "Binaural Downmix" is not compensated for by the affording of spatialization effects, according to the feeling of users.

Here again, the construction within the meaning of the present invention aims to improve the situation. The implementation of the invention such as described hereinabove makes it possible to safeguard the perceived timbre of the sound sources from any distortion.

Indeed, the filtering of the contralateral component, defined by the contralateral transfer function deconvolved with the ipsilateral transfer function, makes it possible to reduce the distortion of timbre afforded by the binauralization processing. As will be seen further on, such a filtering amounts to a low-pass filtering delayed by a value corresponding to the interaural delay. It is advantageously possible to choose a cutoff frequency of the low-pass filter for all the HRTF pairs at about 500 Hz, with a very sizable filter slope. The brain perceives, on one ear, the original signal (without processing) and, on the other ear, the delayed and low-pass-filtered signal. Beyond the cutoff frequency, the perceived difference in level with respect to diotic listening to the original signal attenuated by 6dB is tiny. On the other hand, under the cutoff frequency, the signal is perceived twice as strongly. For the signals containing frequencies under the cutoff frequency, the difference in timbre will therefore consist of an amplification of the low frequencies.

Such impairment of timbre can advantageously be eliminated simply by high-pass filtering, which may be the same for all the HRTF transfer functions (directions of loudspeakers). In the case of a processing for binaural playback, the aforementioned impairment of timbre can advantageously be applied to the binaural stereo signal resulting from the sub-mixing. Furthermore, to avoid a difference in loudness between the results of a processing of "Downmix" type and a binauralization processing within the meaning of the invention, provision may furthermore advantageously be made for an automatic gain control at the end of the processing, so as to contrive matters such that the levels that would be delivered by the Downmix processing and the binauralization processing within the meaning of the invention are similar. For this purpose, as will be seen in detail further on, a high-pass filter and an automatic gain control are provided at the end of the processing chain.

Thus, in more generic terms, a chosen gain is furthermore applied to two signals, left track and right track, in a dual-channel representation (binaural or Transaural®), before playback, the chosen gain being controlled so as to limit an energy of the left track and right track signals, to the maximum, to an energy of signals of the virtual loudspeakers. In a practical implementation, an automatic gain control is preferably applied to the two signals, left track and right track, downstream of the application of the frequency-variable weighting factor.

Furthermore, advantage is taken of the processing within the meaning of the invention so as to eliminate the distortion of coloration afforded by the customary binauralization processing. It is indeed apparent that the coloration distortion reduction processing is very simple to carry out when it is implemented in the transformed domain of the sub-bands. Indeed, the equations hereinabove giving the coefficients of matrices become simply:

$$h_{L,C}^{l,m}=g(1+P_{L,R}^{m}\cdot e^{-j\phi_R^m})*\text{Gain}$$

$$h_{R,C}^{l,m}=g(1+P_{R,L}^{m}\cdot e^{-j\phi_L^m})*\text{Gain}$$

$$h_{L,L}^{l,m}=\sqrt{(\sigma_L^{l,m})^2+(\sigma_{Ls}^{lm})^2}*\text{Gain}$$

$$h_{R,L}^{l,m}=e^{-j(w_L^{l,m}\phi_L^m+w_{Ls}^{l,m}\phi_{Ls}^m)}\sqrt{(\sigma_L^{l,m})^2(P_{R,L}^m)^2+(\sigma_{Ls}^{l,m})^2(P_{R,Ls}^m)^2}*\text{Gain}$$

$$h_{L,R}^{l,m}=e^{j(w_R^{l,m}\phi_R^m+w_{Rs}^{l,m}\phi_{Rs}^m)}\sqrt{(\sigma_R^{l,m})^2(P_{L,R}^m)^2+(\sigma_{Rs}^{l,m})^2(P_{L,Rs}^m)^2}*\text{Gain}$$

$$h_{R,R}^{l,m}=\sqrt{(\sigma_R^{l,m})^2+(\sigma_{Rs}^{lm})^2}*\text{Gain}$$

The "Gain" weighting in the equations hereinabove being such that, in an exemplary embodiment:

Gain=0.5 if the frequency band of index m is such that m<9 (or if the frequency f is itself less than 500 Hz) and Gain=1, otherwise.

Thus, in more generic terms, the coefficients of the aforementioned matrix involved in the matrix filtering vary as a function of frequency, according to a weighting of a chosen factor (Gain) less than one, if the frequency is less than a chosen threshold, and of one otherwise. In the exemplary embodiment given hereinabove, the factor is about 0.5 and the chosen frequency threshold is about 500 Hz so as to eliminate a coloration distortion.

It is possible also to apply this gain directly at the processing output, in particular to the output signals before playback on loudspeakers or earpieces, by applying to the equations:

$$y_B^{n,k}=\begin{bmatrix} y_{L_B}^{n,k} \\ y_{R_B}^{n,k} \end{bmatrix}=\begin{bmatrix} h_{11}^{n,k} & h_{12}^{n,k} \\ h_{21}^{n,k} & h_{22}^{n,k} \end{bmatrix}\begin{bmatrix} y_{L_0}^{n,k} \\ y_{R_0}^{n,k} \end{bmatrix},\ 0\le k<K$$

the aforementioned gain, as follows:

$$y_B^{n,k}=\begin{bmatrix} y_{L_B}^{n,k}*\text{Gain} \\ y_{R_B}^{n,k}*\text{Gain} \end{bmatrix}\ 0\le k<K$$

The "Gain" weighting and the automatic gain control can also be integrated into one and the same processing, as follows:

$$\text{Gain}=0.5*\sqrt{\frac{\sum_k\left((y_{L_0}^{n,k})(y_{L_0}^{n,k})^*+(y_{R_0}^{n,k})(y_{R_0}^{n,k})^*\right)}{\sum_k\left((y_{L_B}^{n,k})(y_{L_B}^{n,k})^*+(y_{R_B}^{n,k})(y_{R_B}^{n,k})^*\right)}}$$

if the frequency band of index m is such that m<9 (or if the frequency f is itself less than 500 Hz) and $$\text{Gain}=\sqrt{\frac{\sum_k\left((y_{L_0}^{n,k})(y_{L_0}^{n,k})^*+(y_{R_0}^{n,k})(y_{R_0}^{n,k})^*\right)}{\sum_k\left((y_{L_B}^{n,k})(y_{L_B}^{n,k})^*+(y_{R_B}^{n,k})(y_{R_B}^{n,k})^*\right)}},\ \text{otherwise.}$$

Another advantage afforded by the invention is the transport of the encoded signal and its processing with a decoder so as to improve its sound quality, for example a decoder of MPEG Surround® type.

In the context of the invention where no transfer function is applied for the direct paths (ipsilateral contributions) and an additional processing is provided for on the indirect paths (spectrum of the contralateral transfer function deconvolved with the ipsilateral transfer function), it is interesting to note that by applying a gain of 0.707 to the signals of the central and ambience (rear left and rear right) channels, then the unprocessed part of the stereo sub-mixing (the ipsilateral contributions) exhibits the same form as the result of a processing of Downmix ITU type. It is possible to generalize the foregoing to any type of sub-mixing processing (Downmix). Indeed, a Downmix processing to two channels generally consists in applying a weighting to the channels (of the virtual loudspeakers), and then in summing the N channels to two output signals. Applying a binaural spatialization processing to the Downmix processing consists in applying to the N weighted channels the HRTF filters corresponding to the positions of the N virtual loudspeakers. As these filters are equal to 1 for the ipsilateral contributions, the Downmix processing is indeed retrieved by applying the sum of the ipsilateral contributions.

Therefore, the signals obtained by a binauralization processing within the meaning of the invention arise from a sum of signals of Downmix type and a stereo signal comprising the location indices required by the brain in order to perceive the spatialization of the sounds. This second signal is called "Additional Binaural Downmix" hereinafter, so that the processing within the meaning of the invention, called "Binaural Downmix" here, is such that:

"Binaural Downmix"="Downmix"+"Additional Binaural Downmix".

The latter equation may be generalized to:

"Binaural Downmix"="Downmix"+α"Additional Binaural Downmix"

In this equation, α may be a coefficient lying between 0 and 1. For example, a listener user can choose the level of the coefficient α between 0 and 1, continually or by toggling between 0 and 1 (in "ON-OFF" mode). Thus, it is possible to choose a weighting α of the second processing "Additional Binaural Downmix" in the global processing using the matrix filtering within the meaning of the invention.

It is also possible to consider the weighting α in this equation as a quantization function, for example based on energy thresholding of the result of the ABD (for "Additional Binaural Downmix") processing (with for example, α=0 if the result of the ABD processing exhibits, in a given spectral band, an energy below a threshold, and α=1, otherwise, for this same spectral band). This embodiment exhibits the advantage of requiring only a small passband for the transmission of the results of the Downmix and ABD processing procedures, from a coder to a decoder as represented in FIG. 7 described further on, demanding bitrate only if the result of the ABD processing is significant with respect to the result of the Downmix. Of course, provision may be made for various thresholds with for example α=0; 0.25; 0.5; 0.75; 1.

This additional signal requires only little bitrate to transport it. Indeed, it takes the form of a residual, low-pass-filtered signal which therefore a priori has much less energy than the Downmix signal. Furthermore, it exhibits redundancies with the Downmix signal. This property may be advantageously utilized jointly with codecs of Dolby Surround, Dolby Prologic or MPEG Surround type.

The "Additional Binaural Downmix" signal can then be compressed and transported in an additional and/or scalable manner with the Downmix signal, with little bitrate. During headset listening, the addition of the two stereo signals allows the listener to profit fully from the binaural signal with a quality that is very similar to a 5.1 format.

Thus, it suffices to decode the "Additional Binaural Downmix" signal and to add it directly to the Downmix signal. Provision may be made to embody a scalable coder, transporting for example by default a stereo signal without binauralization effect, and, if the bitrate so allows, furthermore transporting an additional-signal over-layer for the binauralization.

In the case of the MPEG Surround coder, in which provision is currently made, in one of its operational modes, to transport a stereo signal (of Downmix type) and to carry out the binauralization processing in the coded (or transformed) domain, reduced complexity and a better quality of rendition is obtained. In the case of headset rendition, the decoder simply has to calculate the "Additional Binaural Downmix" signal. The complexity is therefore reduced, without any risk of degradation of the signal of Downmix type. The sound quality thereof can only be improved.

Such characteristics are summarized as follows: the matrix filtering within the meaning of the invention consists in applying, in an advantageous embodiment:

- a first sub-mixing processing of the N channels into two stereo signals (for example of Downmix type), and
- a second processing leading, when it is executed jointly with the first processing, to a spatialization of the N virtual loudspeakers respectively associated with the N channels so as to obtain a binaural or Transaural®, dual-channel representation.

Advantageously, the application of the second processing is decided as an option (for example as a function of the bitrate, of the capabilities for spatialized playback of a terminal, or the like). The aforementioned first processing may be applied in a coder communicating with a decoder, while the second processing is advantageously applied at the decoder.

The management of the processing procedures within the meaning of the invention can advantageously be conducted by a computer program comprising instructions for the implementation of the method according to the invention, when this program is executed by a processor, for example with a decoder in particular. In this respect, the invention is also aimed at such a program.

The present invention is also aimed at a module equipped with a processor and with a memory, and which is able to execute this computer program. A module within the meaning of the invention, for the processing of sound data encoded in a sub-band domain, with a view to dual-channel playback of binaural or Transaural® type, hence comprises means for applying a matrix filtering so as to pass from a sound representation with N channels with N>0, to a dual-channel representation. The sound representation with N channels consists in considering N virtual loudspeakers surrounding the head of a listener, and, for each virtual loudspeaker of at least some of the loudspeakers:

- a first transfer function specific to an ipsilateral path from the loudspeaker to a first ear of the listener, facing the loudspeaker, and
- a second transfer function specific to a contralateral path from said loudspeaker to the second ear of the listener, masked from the loudspeaker by the listener's head.

The matrix filtering applied comprises a multiplicative coefficient defined by the spectrum, in the sub-band domain, of the second transfer function deconvolved with the first transfer function.

Such a module can advantageously be a decoder of MPEG Surround® type and furthermore comprise decoding means of MPEG Surround® type, or can, as a variant, be built into such a decoder.

BRIEF DESCRIPTION OF THE DRAWINGS

Other characteristics and advantages of the invention will be apparent on examining the detailed description hereinafter and the appended drawings in which:

FIG. 4A schematically represents the ipsilateral (solid lines) and contralateral (dashed lines) paths in 5.1 multi-channel format, with furthermore the ipsilateral and contralateral paths of the central loudspeaker;

FIG. 4B represents a processing diagram for passing from a 5.1 multi-channel format illustrated in FIG. 4A to a binaural or transaural format, with four filters only in an embodiment within the meaning of the invention;

DETAILED DESCRIPTION

Figure 1:
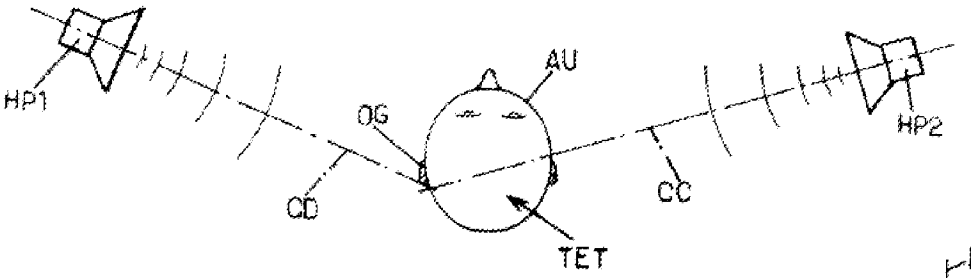
FIG. 1 schematically represents a playback on two loudspeakers around the head of a listener.
Figure 2:
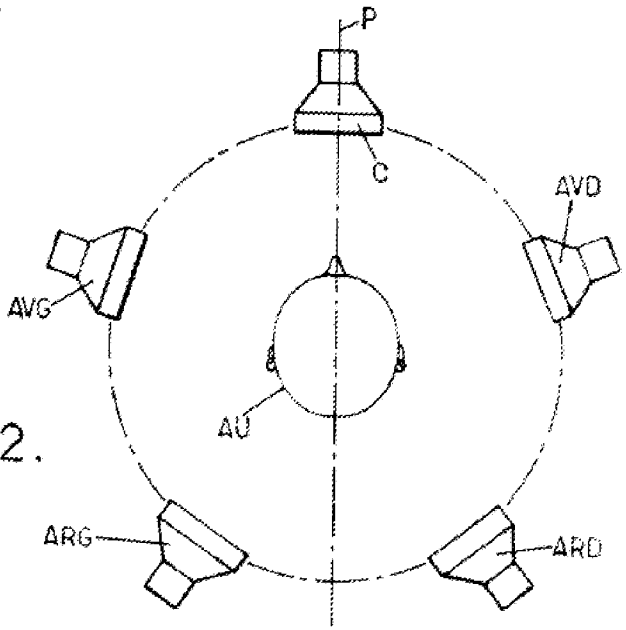
FIG. 2 schematically represents a playback on five loudspeakers in 5.1 multi-channel format.
Figure 3A:
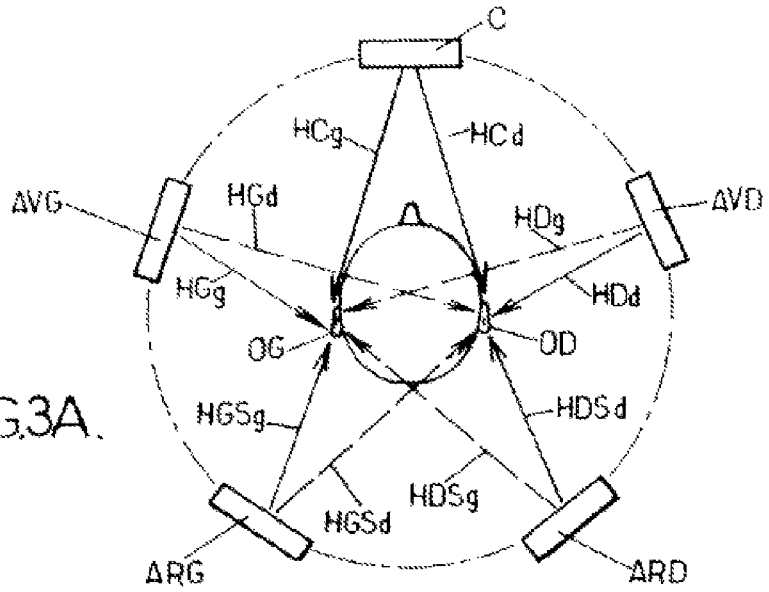
FIG. 3A schematically represents the ipsilateral paths (solid lines) and contralateral (dashed lines) in 5.1 multi-channel format.
Figure 3B:
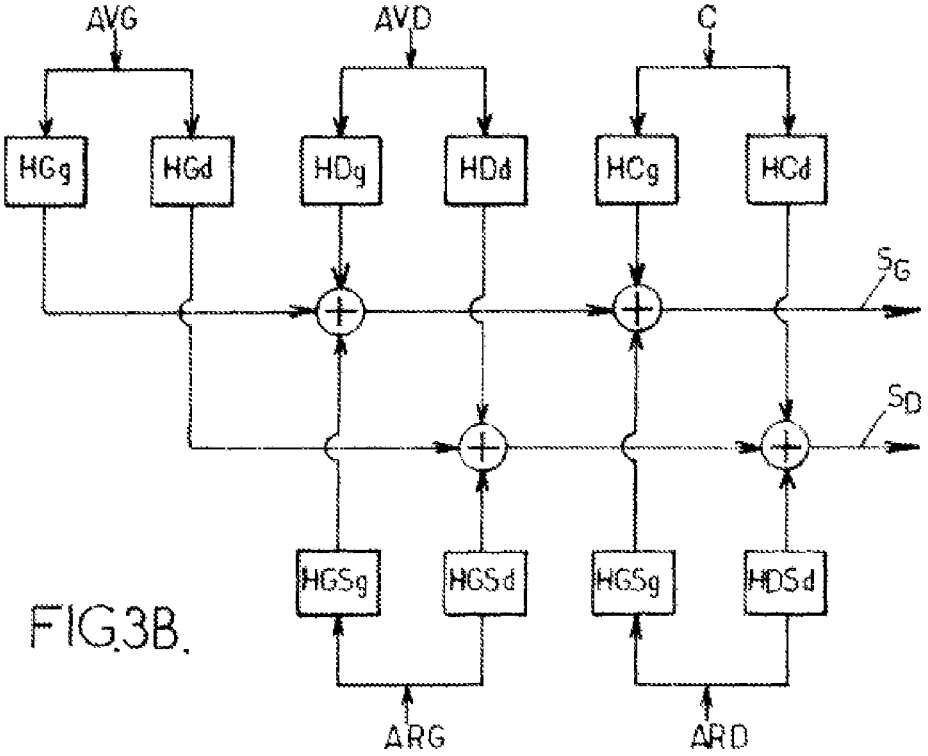
FIG. 3B represents a processing diagram of the prior art for passing from a 5.1 multi-channel format illustrated in FIG. 3A to a binaural or transaural format.

Reference is made firstly to FIG. 4A to describe an exemplary implementation of the processing to pass from a multichannel representation (5.1 format in the example described) to a binaural or Transaural® stereo dual-channel representation. In this figure, five loudspeakers in configuration according to the 5.1 format are illustrated:

- a front loudspeaker C situated facing the listener, in a mid-plane (plane P of FIG. 2),
- a left lateral loudspeaker AVG,
- a right lateral loudspeaker AVD, and
- a rear left loudspeaker ARG to produce a so-called "surround" effect,
- a right rear loudspeaker ARD to also produce a so-called "surround" effect.

With reference now to FIG. 4B, the playback of the audio content in a binaural or transaural context is intended to be performed on a first track $S_G$ and a second track $S_D$, this content being initially encoded in a multi-channel format (with N channels with N=5 in the example described) in which each channel is associated with a loudspeaker position with respect to the listener (FIG. 4A).

Advantageously, the channels associated with positions of loudspeakers (for example the loudspeakers AVG and ARG of FIG. 4A) in a first hemisphere with respect to the listener (that of the left ear OG) are grouped together and applied directly to the track $S_G$ of FIG. 4B. The channels associated with the positions of the loudspeakers AVD and ARD in a second hemisphere with respect to the listener (that of his right ear OD) are grouped together and applied directly to the other track $S_D$ of FIG. 4B. It is specified that the first and second hemispheres are separated by the mid-plane of the listener. These components of signals AVG, ARG being applied directly to the track $S_G$, on the one hand, and the components of signals AVD, ARD being applied directly to the track $S_D$, on the other hand, it will be noted, in the example of FIG. 4B, that no particular processing is applied to them.

Again with reference to FIG. 4B, the channels AVG and ARG associated with positions of the first hemisphere are grouped together and also applied to the second track $S_D$, and the channels AVD and ARD associated with positions of the second hemisphere are grouped together and also applied to the first track $S_G$. Here, provision is made for an additional processing to be applied:

- to each channel AVG and ARG of the first hemisphere intended for the second track $S_D$, and
- to each channel AVD and ARD of the second hemisphere intended for the first track $S_G$.

The additional processing preferably comprises the application of a filtering $(C/I)_{AVG}$, $(C/I)_{AVD}$, $(C/I)_{ARG}$, $(C/I)_{ARD}$ (FIG. 4B) defined, in the coded (or transformed) domain, by the spectrum of a contralateral acoustic transfer function deconvolved with an ipsilateral transfer function. More precisely, the ipsilateral transfer function is associated with a direct acoustic pathway $I_{AVG}$, $I_{AVD}$, $I_{ARG}$, $I_{ARD}$ (FIG. 4A) between a loudspeaker position and one ear of the listener and the contralateral transfer function is associated with an acoustic pathway $C_{AVG}$, $C_{AVA}$, $C_{ARD}$, $C_{ARD}$ (FIG. 4A) passing through the head of the listener, between the aforementioned loudspeaker position and the other ear of the listener.

Thus, for each channel associated with a virtual loudspeaker situated outside of the mid-plane (therefore all the loudspeakers except the front loudspeaker), the spatialization of the virtual loudspeaker is ensured by a pair of transfer functions, HRTF (expressed in the frequency domain) or HRIR (expressed in the time domain). These transfer functions translate the ipsilateral path (direct path between the loudspeaker and the closer ear, solid line in FIG. 4A) and the contralateral path (path between the loudspeaker and the ear masked by the listener's head, dashed lines in FIG. 4A).

Rather than use raw transfer functions for each path as in the sense of the prior art, the filter associated with the ipsilateral path is advantageously eliminated and a filter corresponding to the contralateral transfer function deconvolved with the ipsilateral transfer function is used for the contralateral path. Thus, for each virtual loudspeaker (except for the central loudspeaker C), a single filter is used.

Thus, with reference to FIG. 4B:

- the filter referenced $(C/I)_{ARG}$ is defined, in the transformed domain, by the spectrum of the contralateral transfer function of the path between the rear left loudspeaker ARG and the right ear OD deconvolved with the ipsilateral transfer function of the path between the rear left loudspeaker ARG and the left ear OG of the individual,
- the filter referenced $(C/I)_{ARD}$ is defined, in the transformed domain, by the spectrum of the contralateral transfer function of the path between the right rear loudspeaker ARD and the left ear OG deconvolved with the ipsilateral transfer function of the path between the right rear loudspeaker ARD and the right ear OD of the individual,
- the filter referenced $(C/I)_{AVG}$ is defined, in the transformed domain, by the spectrum of the contralateral transfer function of the path between the left lateral loudspeaker AVG and the right ear OD deconvolved with the ipsilateral transfer function of the path between the left lateral loudspeaker AVG and the left ear OG of the individual, and
- the filter referenced $(C/I)_{AVD}$ is defined, in the transformed domain, by the spectrum of the contralateral transfer function of the path between the right lateral loudspeaker AVD and the left ear OG deconvolved with the ipsilateral transfer function of the path between the right lateral loudspeaker AVD and the right ear OD of the individual.

Moreover, the signal which, in 5.1 encoding, is intended to feed the central loudspeaker C (in the mid-plane of symmetry of the listener's head), is distributed as two fractions (preferably in a manner equal to 50% and 50%) on two tracks which add together on two respective tracks of the left and right lateral loudspeakers. In the same manner, if there is provision for a rear loudspeaker in the mid-plane, the associated signal is mixed with the signals associated with the rear left ARG and rear right ARD loudspeakers. Of course, if there are several central loudspeakers (front loudspeaker for playback of the middle frequencies, front loudspeaker for playback of the low frequencies, or the like) their signals are added together and again apportioned over the signals associated with the lateral loudspeakers.

As the channel associated with a loudspeaker central position C, in the mid-plane, is apportioned in a first and a second signal fraction, respectively added to the channel of the loudspeaker AVG in the first hemisphere (around the left ear OG) and to the channel of the loudspeaker AVD in the second hemisphere (around the right ear OD), it is not necessary to make provision for filterings by the transfer functions associated with the loudspeakers situated in the mid-plane, this being the case with no change in the perception of the spatialization of the sound scene in binaural or Transaural® playback.

Of course, provision can also be made for a processing for passing from a multi-channel format with N channels, with N still larger than 5 (7.1 format or the like) to a binaural format. For this purpose, it suffices, by adding two extra lateral loudspeakers, to provide for the same types of filters (represented by the contralateral HRTF deconvolved with the ipsilateral HRTF) for example for two additional loudspeakers in the 7.1 initial format.

The processing complexity is greatly reduced since the filters associated with the loudspeakers situated in the mid-plane are eliminated. Another advantage is that the effect of coloration of the associated signals is reduced.

The spectrum of the contralateral transfer function deconvolved with the ipsilateral transfer function may be defined, in the transformed domain, by:

- the gain of the transform of the contralateral transfer function deconvolved with the ipsilateral transfer function, and
- the delay defined by the difference of the respective phases of the contralateral and ipsilateral transfer functions,
- and optionally as a function of an estimation of coherence between the left track and the right track, in particular in the case of a single initial mono source to be spatialized in the 5.1 format and then in the binaural format (this case being described further on).

As a first approximation, it may simply be considered that the ratio of the respective gains of the transforms of the transfer functions, in each frequency band considered, is close to the gain of the transform of the contralateral transfer function deconvolved with the ipsilateral transfer function. The gains of the transforms of the contralateral and ipsilateral transfer functions, as well as their phases, in each spectral band, are given for example in annex C of the aforementioned standard "*Information technology—MPEG audio technologies—Part* 1: *MPEG Surround*", ISO/IEC JTC 1/SC 29 (21 Jul. 2006), for a PQMF transform in 64 sub-bands.

Thus, as a first approximation, for a contralateral path and in a given spectral band m, the spectrum of the contralateral transfer function deconvolved with the ipsilateral transfer function may be defined, in the transformed domain, by:

$$P_{R,L}^{m} = \frac{G_{R,L}^{m}}{G_{L,L}^{m}} \exp j(\Phi_{R,L}^{m} - \Phi_{L,L}^{m}),$$

$G_{R,L}{}^{m}$ and $\Phi_{R,L}{}^{m}$ being the gain and the phase of the contralateral transfer function and $G_{L,L}{}^{m}$ and $\Phi_{L,L}{}^{m}$ being the gain and the phase of the ipsilateral transfer function.

Figure 5:
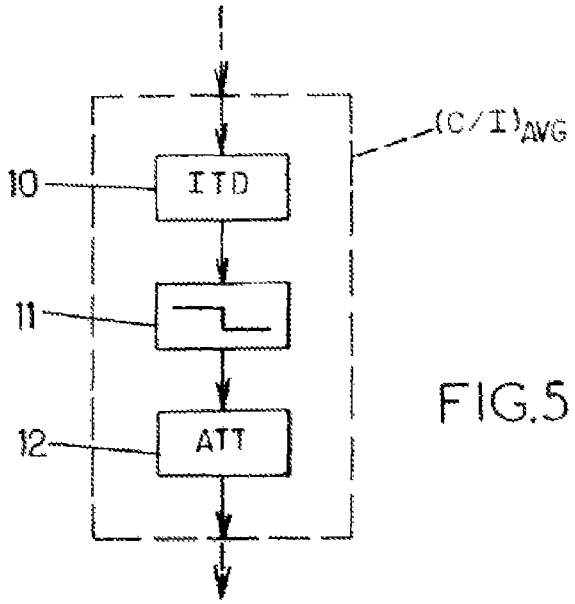
FIG. 5 illustrates a processing equivalent to the application of one of the filters of FIG. 4B.

With reference to FIG. 5, each filter is equivalent to applying:

- an equalizer filtering 11, preferably of low-pass type,
- advantageously an interaural delay (or "ITD") 10, to take account of the path differences between a virtual source and each ear, and
- optionally an attenuation 12 with respect to the unfiltered components of signals (for example the component AVG on the track $S_G$ of FIG. 4B).

It is appropriate to indicate here that the delay ITD applied is "substantially" interaural, the term "substantially" referring in particular to the fact that rigorous account may not be taken of the strict morphology of the listener (for example if HRTFs are used by default, in particular HRTFs termed "Kemar's head").

Thus, the binaural synthesis of a virtual loudspeaker (AVG for example) consists simply in playing without modification the input signal on the ipsilateral relative track (track $S_G$ in FIG. 4B) and applying to the signal to be played on the contralateral track (track $S_D$ in FIG. 4B) a corresponding filter $(C/I)_{AVG}$ as the application of a delay, of an attenuation and of a low-pass filtering. Thus, the resulting signal is delayed, attenuated and filtered by eliminating the high frequencies, this being manifested, from the point of view of auditory perception, by a masking of the signal received by the "contralateral" ear (OD, in the example where the virtual loudspeaker is the left lateral AVG), in relation to the signal received by the "ipsilateral" ear (OG).

Figure 6:
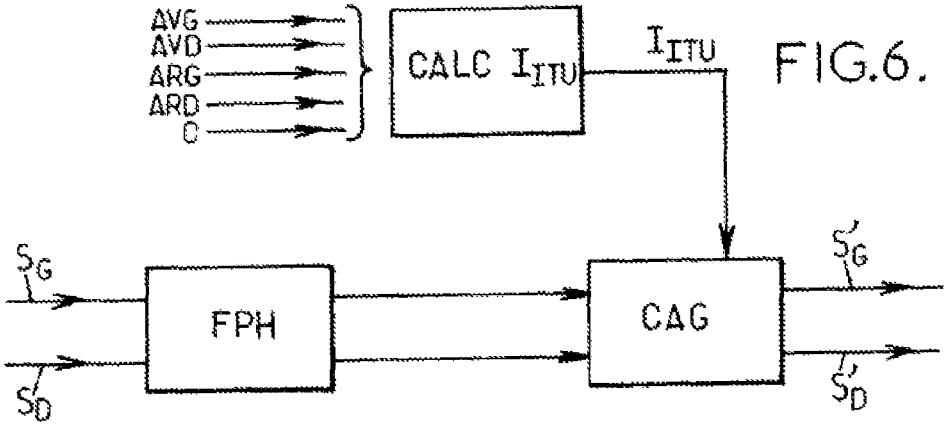
FIG. 6 illustrates an additional processing of high-pass filtering and automatic gain control to be applied to the outputs $S_G$ and $S_D$ to avoid a coloration distortion and a difference of timbre between a "Downmix" processing and a processing within the meaning of the invention.

The coloration which may be perceived is therefore directly that of the signal received by the ipsilateral ear. Now, in an advantageous manner, this signal does not undergo any transformation and, consequently, the processing within the meaning of the invention ought to afford only weak coloration. However, by way of complementary precaution, with reference to FIG. 6, provision may be made for a processing of the output signals $S_G$ and $S_D$ of FIG. 4B consisting in applying a high-pass filter FPH, followed by an automatic gain control CAG.

The high-pass filter amounts to applying the "Gain" factor described hereinabove, with:

Gain=0.5 if the frequency f is less than 500 Hz and

Gain=1 otherwise.

Advantageously, in this embodiment, this factor is applied globally at output of the signals $S_G$ and $S_D$, as a variant of an individual application to each coefficient of the matrix $$\begin{bmatrix} h_{L,L}^{L,\kappa(k)} & h_{L,R}^{L,\kappa(k)} & h_{L,C}^{L,\kappa(k)} \\ h_{R,L}^{L,\kappa(k)} & h_{R,R}^{L,\kappa(k)} & h_{R,C}^{L,\kappa(k)} \end{bmatrix}$$

explained further on.

Advantageously, the automatic gain control is tied to the global intensity of the signals corresponding to the Downmix processing, given by:

$$I_D = \sqrt{I_{AVG}{}^2 + I_{AVD}{}^2 + g_s{}^2 I_{ARG}{}^2 + g_s{}^2 I_{ARD}{}^2 + g^2 I_C{}^2},$$

where $$I_{AVG}{}^2, I_{AVD}{}^2, I_{ARG}{}^2, I_{ARD}{}^2, I_C{}^2$$

are the respective energies of the signals of the front left, front right, rear left, rear right and center channels of a 5.1 format. The gains g and $g_s$ are applied globally to the signal C for the gain g and to the signals ARG and ARD for the gain $g_s$. Stated otherwise, the energy of the left track signals $S'_G$ and right track signals $S'_D$ is thereby limited on completion of this processing, to the maximum, to the global energy $I_D{}^2$ of the signals of the virtual loudspeakers. The signals recovered $S'_G$ and $S'_D$ may ultimately be conveyed to a device for sound playback, in binaural stereophonic mode.

In practice, in a coder in particular of MPEG Surround type, the global intensity of the signals is customarily calculated directly on the basis of the energy of the input signals. Thus, in a variant this datum will be taken into account in estimating the intensity $I_D$.

The implementation of the invention then results in elimination of the monaural location indices. Now, the more a source deviates from the mid-plane, the more predominant the interaural indices become, to the detriment of the monaural indices. Having regard to the fact that in recommendation ITU-R BS.775 relating to the disposition of the loudspeakers of the 5.1 system, the angle between the lateral loudspeakers (or between the rear loudspeakers) is greater than 60°, the elimination of the monaural indices has only little influence on the perceived position of the virtual loudspeakers. Moreover, the difference perceived here is less than the difference that could be perceived by the listener due to the fact that the HRTFs used were not specific to him (for example, models of HRTFs derived from the so-called "Kemar head" technique).

Thus, the spatial perception of the signal is kept, doing so without affording coloration and while preserving the timbre of the sound sources.

Further still, the solution within the meaning of the present invention substantially halves the number of filters to be provided and furthermore corrects the coloration effects.

Moreover, it has been observed that the choice of the position of the virtual loudspeakers can appreciably influence the quality of the result of the spatialization. Indeed, it has turned out to be preferable to place the lateral and rear virtual loudspeakers at +/−45° with respect to the mid-plane, rather than at +/−30° to the mid-plane according to the configuration recommended by the International Telecommunications Union (ITU). Indeed, when the virtual loudspeakers approach the mid-plane, the ipsilateral and contralateral HRTF functions tend to resemble one another and the previous simplifications may no longer give satisfactory spatialization.

Thus, in generic terms, by considering an initial multichannel format defining at least four positions:

of two lateral loudspeakers, symmetric with respect to the mid-plane, and of two rear loudspeakers, symmetric with respect to the mid-plane, the position of a lateral loudspeaker is advantageously included in an angular sector of 10° to 90° and preferably of 30 to 60° from a symmetry plane P and facing the listener's face. More particularly, the position of a lateral loudspeaker will preferably be close to 45° from the symmetry plane.

Figure 7:
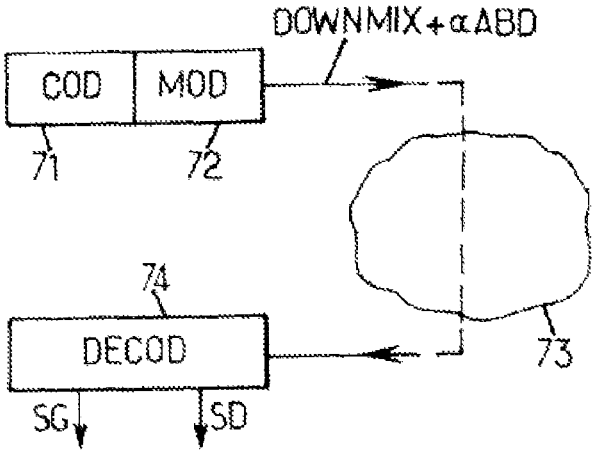
FIG. 7 illustrates the situation of a processing within the meaning of the invention, carried out with the coder in a possible exemplary embodiment of the invention, in particular in the case of an additional ABD processing to be combined with the Downmix processing.

FIG. 7 is now referred to in order to describe a possible embodiment of the invention in which the processing within the meaning of the invention intervenes after the step of coding the sound data, for example before transmission to a decoder 74 via a network 73. Here, a processing module within the meaning of the invention 72 intervenes directly downstream of a coder 71, so as to deliver, as indicated previously, data processed according to a processing of the type:

Downmix+αABD (with ABD for "Additional Binaural Downmix").

A possible embodiment of such a processing is described hereinafter.

Starting from a 5.0 signal (L, R, C, Ls, Rs) to be coded and transported, we thus consider a global Downmix processing of the type:

$$\begin{bmatrix} L_0^{l,m} \\ R_0^{l,m} \end{bmatrix} = \begin{bmatrix} L^{l,m} + g * C^{l,m} + L_s^{l,m} \\ R^{l,m} + g * C^{l,m} + R_s^{l,m} \end{bmatrix}$$

The signals $L_0^{l,m}$ and $R_0^{l,m}$ therefore correspond to the two stereo signals, without spatialization effect, that could be delivered by a decoder so as to feed two loudspeakers in sound playback.

The calculation of the Downmix processing, without binauralization filtering, ought therefore to make it possible to retrieve these two signals $L_0^{l,m}$ and $R_0^{l,m}$, this then being expressed for example as follows:

$$\tilde{L}_0^{l,m} = \tilde{L}^{l,m} + g\tilde{C}^{l,m} + \tilde{L}_s^{l,m}$$

$$\tilde{R}_0^{l,m} = \tilde{R}^{l,m} + g\tilde{C}^{l,m} + \tilde{R}_s^{l,m}$$

By now applying a binaural filtering and by apportioning the signal of the central loudspeaker over the channels L and R in an equal manner with the gain g, we obtain:

$$\tilde{L}_B^{l,m} = (\tilde{L}^{l,m} + g\tilde{C}^{l,m})P_{L,L}^n + (\tilde{R}^{l,m} + g\tilde{C}^{l,m})P_{L,R}^n \cdot e^{-j\phi_R^m} + \tilde{L}_s^{l,m}P_{L,L_s}^n + \tilde{R}_s^{l,m}P_{L,R_s}^n \cdot e^{-j\phi_{R_s}^m}$$

$$\tilde{R}_B^{l,m} = (\tilde{R}^{l,m} + g\tilde{C}^{l,m})P_{R,R}^n + (\tilde{L}^{l,m} + g\tilde{C}^{l,m})P_{R,L}^n \cdot e^{-j\phi_L^m} + \tilde{R}_s^{l,m}P_{R,R_s}^n + \tilde{L}_s^{l,m}P_{R,L_s}^n \cdot e^{-j\phi_{L_s}^m}$$

If the contralateral HRTF functions deconvolved with the ipsilateral HRTF functions are used for the contralateral filtering, we have $P_{L,L}^m = P_{R,R}^m = P_{L,L_s}^m = P_{R,R_s}^m = 1$, and $$\tilde{L}_B^{l,m} = (\tilde{L}^{l,m} + g\tilde{C}^{l,m} + \tilde{L}_s^{l,m}) + (\tilde{R}^{l,m} + g\tilde{C}^{l,m})P_{L,R}^n \cdot e^{-j\phi_R^m} + \tilde{R}_s^{l,m}P_{L,R_s}^n \cdot e^{-j\phi_{R_s}^m}$$

$$\tilde{R}_B^{l,m} = (\tilde{R}^{l,m} + g\tilde{C}^{l,m} + \tilde{R}_s^{l,m}) + (\tilde{L}^{l,m} + g\tilde{C}^{l,m})P_{R,L}^n \cdot e^{-j\phi_L^m} + \tilde{L}_s^{l,m}P_{R,L_s}^n \cdot e^{-j\phi_{L_s}^m}$$

and therefore:

$$\tilde{L}_B^{l,m} = \tilde{L}_0^{l,m} + (\tilde{R}^{l,m} + g\tilde{C}^{l,m})P_{L,R}^n \cdot e^{-j\phi_R^m} + \tilde{R}_s^{l,m}P_{L,R_s}^n \cdot e^{-j\phi_{R_s}^m}$$

$$\tilde{R}_B^{l,m} = \tilde{R}_0^{l,m} + (\tilde{L}^{l,m} + g\tilde{C}^{l,m})P_{R,L}^n \cdot e^{-j\phi_L^m} + \tilde{L}_s^{l,m}P_{R,L_s}^n \cdot e^{-j\phi_{L_s}^m}$$

The additional binaural Downmix may be written:

$$\tilde{L}_{DBA}^{l,m} = (\tilde{R}^{l,m} + g\tilde{C}^{l,m})P_{L,R}^n \cdot e^{-j\phi_R^m} + \tilde{R}_s^{l,m}P_{L,R_s}^n \cdot e^{-j\phi_{R_s}^m}$$

$$\tilde{R}_{DBA}^{l,m} = (\tilde{L}^{l,m} + g\tilde{C}^{l,m})P_{R,L}^n \cdot e^{-j\phi_L^m} + \tilde{L}_s^{l,m}P_{R,L_s}^n \cdot e^{-j\phi_{L_s}^m}$$

Returning to the example of a matrix filtering expressed according to a product of matrices of type:

$$H_1^{l,m} = \begin{bmatrix} h_{L,L}^{l,m} & h_{L,R}^{l,m} & h_{L,C}^{l,m} \\ h_{R,L}^{l,m} & h_{R,R}^{l,m} & h_{R,C}^{l,m} \end{bmatrix} \cdot \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot W_{temp}^{l,m},$$

where $W^{l,m}$ represents a processing matrix for expanding two stereo signals to M' channels, with M'>2 (for example M'=3), this matrix $W^{l,m}$ being expressed as a 2×6 matrix of the type:

$$W^{l,m} = \begin{pmatrix} w_{11} & w_{12} \\ w_{21} & w_{22} \\ w_{31} & w_{32} \\ w_{41} & w_{42} \\ w_{51} & w_{52} \\ w_{61} & w_{62} \end{pmatrix}.$$

In particular, in the aforementioned MPEG Surround standard, the coefficients of the matrix $$\begin{bmatrix} h_{L,L}^{l,m} & h_{L,R}^{l,m} & h_{L,C}^{l,m} \\ h_{R,L}^{l,m} & h_{R,R}^{l,m} & h_{R,C}^{l,m} \end{bmatrix}$$

are such that:

$$H_1^{l,m} = \begin{bmatrix} h_{L,L}^{l,m} & h_{L,R}^{l,m} & h_{L,C}^{l,m} \\ h_{R,L}^{l,m} & h_{R,R}^{l,m} & h_{R,C}^{l,m} \end{bmatrix} \cdot \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot W_{temp}^{l,m}$$

$$= \begin{bmatrix} 1 & P_{L,R}^{n} e^{-j\phi_R} & g(1 + P_{L,R}^{n} e^{-j\phi_R}) & 1 & P_{L,R_s}^{n} e^{-j\phi_{R_s}} \\ P_{L,R}^{n} e^{-j\phi_L} & 1 & g(1 + P_{R,L}^{n} e^{-j\phi_L}) & P_{L,R_s}^{n} e^{-j\phi_{L_s}} & 1 \end{bmatrix} \begin{bmatrix} \sigma_L^{l,m} & 0 & 0 \\ 0 & \sigma_R^{l,m} & 0 \\ 0 & 0 & 1 \\ \sigma_{L_s}^{l,m} & 0 & 0 \\ 0 & \sigma_{R_s} & 0 \end{bmatrix} \cdot \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot W_{temp}^{l,\kappa(m)}$$

Expanding this product, we find:

$$H_1^{l,m} = \begin{bmatrix} \sigma_L^{l,m} + \sigma_{L_s}^{l,m} & P_{L,R}^{n} e^{-j\phi_R} \sigma_R^{l,m} + P_{L,R_s}^{n} e^{-j\phi_{R_s}} \sigma_{R_s}^{l,m} & g(1 + P_{L,R}^{n} e^{-j\phi_R}) \\ P_{R,L}^{n} e^{-j\phi_L} \sigma_L^{l,m} + P_{R,L_s}^{n} e^{-j\phi_{L_s}} \sigma_{L_s}^{l,m} & \sigma_R^{l,m} + \sigma_{R_s}^{l,m} & g(1 + P_{L,R}^{n} e^{-j\phi_R}) \end{bmatrix} \cdot \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot W_{temp}^{l,\kappa(m)}$$

Seeking an addition of two distinct matrices, we find:

$$H_1^{l,m} = \left[ \begin{bmatrix} \sigma_L^{l,m} + \sigma_{L_s}^{l,m} & 0 & g \\ 0 & \sigma_R^{l,m} + \sigma_{R_s}^{l,m} & g \end{bmatrix} + \begin{bmatrix} 0 & P_{L,R}^{n} e^{-j\phi_R} \sigma_R^{l,m} + P_{L,R_s}^{n} e^{-j\phi_{R_s}} \sigma_{R_s}^{l,m} & g P_{L,R}^{n} e^{-j\phi_R} \\ P_{R,L}^{n} e^{-j\phi_L} \sigma_L^{l,m} + P_{R,L_s}^{n} e^{-j\phi_{L_s}} \sigma_{L_s}^{l,m} & 0 & g P_{L,R}^{n} e^{-j\phi_R} \end{bmatrix} \right] \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot W_{temp}^{l,\kappa(m)}$$

which will be written hereinafter:

$$H_1^{l,m} = H_{DB}^{l,m} = [h_D^{l,m} + h_{ABD}^{l,m}] \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot W_{temp}^{l,\kappa(m)}$$

with $h_D^{l,m}$ for the Downmix processing and $h_{ABD}^{l,m}$ for the Additional Binaural Downmix processing.

It is possible to consider, in this embodiment, that the coefficients of the matrix $$\begin{bmatrix} h_{L,L}^{l,m} & h_{L,R}^{l,m} & h_{L,C}^{l,m} \\ h_{R,L}^{l,m} & h_{R,R}^{l,m} & h_{R,C}^{l,m} \end{bmatrix}$$

are indeed given by:

$$h_{L,C}^{l,m} = g(1 + P_{L,R}^{m} \cdot e^{-j\phi_{R_m}})$$

$$h_{R,C}^{l,m} = g(1 + P_{R,L}^{m} \cdot e^{-j\phi_{L_m}})$$

$$h_{L,L}^{l,m} = \sigma_L^{l,m} + \sigma_{Ls}^{lm}$$

$$h_{L,R}^{l,m} = P_{L,R}^{m} e^{-j\phi_R} \sigma_R^{l,m} + P_{L,R_s}^{m} e^{-j\phi_{Rs}} \sigma_{R_s}^{l,m}$$

$$h_{R,L}^{l,m} = P_{R,L}^{m} e^{-j\phi_L} \sigma_L^{l,m} + P_{R,L_s}^{m} e^{-j\phi_{Ls}} \sigma_{L_s}^{l,m}$$

$$h_{R,R}^{l,m} = \sigma_R^{l,m} + \sigma_{R_s}^{l,m}$$

$$h_{L,C}^{l,m} = g(1 + P_{L,R}^{m} \cdot e^{-j\phi_R^{m}})$$

$$h_{R,C}^{l,m} = g(1 + P_{R,L}^{m} \cdot e^{-j\phi_L^{m}})$$

as set forth previously.

It is possible to consider as a first approximation that a lateral channel (right or left) and the corresponding rear lateral channel (right or left respectively) are mutually decorrelated. This assumption is reasonable insofar as the rear channel in general merely takes up the hall reverberation or the like (delayed in time) of the signal of the lateral channel. In this case, the channels L and Ls and the channels R and Rs have disjoint time frequency supports and we then have $\sigma_L^{l,m} \sigma_{Ls}^{l,m} = 0$ and $\sigma_R^{l,m} \sigma_{Rs}^{l,m} = 0$, and:

$$h_{L,L}^{l,m} = \sigma_L^{l,m} + \sigma_{Ls}^{l,m} = \sqrt{(\sigma_L^{l,m} + \sigma_{Ls}^{l,m})^2} = \sqrt{(\sigma_L^{l,m})^2 + 2 * \sigma_L^{l,m} \sigma_{Ls}^{l,m} + (\sigma_{Ls}^{l,m})^2} = \sqrt{(\sigma_L^{l,m})^2 + (\sigma_{Ls}^{l,m})^2}$$

$$h_{R,R}^{l,m} = \sigma_R^{l,m} + \sigma_{Rs}^{l,m} = \sqrt{(\sigma_R^{l,m} + \sigma_{Rs}^{l,m})^2} = \sqrt{(\sigma_R^{l,m})^2 + 2 * \sigma_R^{l,m} \sigma_{Rs}^{l,m} + (\sigma_{Rs}^{l,m})^2} = \sqrt{(\sigma_R^{l,m})^2 + (\sigma_{Rs}^{l,m})^2}$$

On the other hand the above assumption cannot be satisfied for all the signals. In the case where the signals were to have a common time frequency support, it is preferable to seek to preserve the energies of the signals. This precaution is advocated moreover in the MPEG Surround standard. Indeed, the addition of signals in phase opposition ($\sigma_L^{l,m} = -\sigma_{Ls}^{lm}$) cancels out. As indicated above, such a situation never occurs in practice, when considering the case of a hall with a reverberation effect on the Surround channels.

Nonetheless, in the example described below, variants of the above formulae are used to retain the energy of the signals in the Downmix processing, as follows:

$$h_{L,C}^{l,m}=g(1+P_{L,R}^{m}\cdot e^{-j\phi_R^m})$$

$$h_{R,C}^{l,m}=g(1+P_{R,L}^{m}\cdot e^{-j\phi_L^m})$$

$$h_{L,L}^{l,m}=\sqrt{(\sigma_L^{l,m})^2+(\sigma_{Ls}^{lm})^2}$$

$$h_{R,L}^{l,m}=e^{-j(w_L^{l,m}\phi_L^m+w_{Ls}^{l,m}\phi_{Ls}^m)}\sqrt{(\sigma_L^{l,m})^2(P_{R,L}^m)^2+(\sigma_{Ls}^{l,m})^2(P_{R,Ls}^m)^2}$$

$$h_{L,R}^{l,m}=e^{j(w_R^{l,m}\phi_R^m+w_{Rs}^{l,m}\phi_{Rs}^m)}\sqrt{(\sigma_R^{l,m})^2(P_{L,R}^m)^2+(\sigma_{Rs}^{l,m})^2(P_{L,Rs}^m)^2}$$

$$h_{R,R}^{l,m}=\sqrt{(\sigma_R^{l,m})^2+(\sigma_{Rs}^{lm})^2}$$

The global processing matrix $H_1^{l,k}$ is still expressed as the sum of two matrices:

$$H_1^{l,m}=H_D^{l,m}+H_{ABD}^{l,m}=[h_D^{l,m}+h_{ABD}^{l,m}]\begin{bmatrix}1&0&0&0&0&0\\0&1&0&0&0&0\\0&0&1&0&0&0\end{bmatrix}\cdot W_{temp}^{l,k(m)},$$

with:

$$H_D^{l,m}=\begin{bmatrix}\sqrt{(\sigma_L^{l,m})^2+(\sigma_{Ls}^{l,m})^2}&0&g\\0&\sqrt{(\sigma_R^{l,m})^2+(\sigma_{Rs}^{l,m})^2}&g\end{bmatrix}\cdot\begin{bmatrix}1&0&0&0&0&0\\0&1&0&0&0&0\\0&0&1&0&0&0\end{bmatrix}\cdot W_{temp}^{l,k(m)}$$

and $$H_{ABD}^{l,m}=\begin{bmatrix}0&X_{12}&gP_{L,R}^m e^{-j\phi_R}\\X_{21}&0&gP_{R,L}^m e^{-j\phi_L}\end{bmatrix}\cdot\begin{bmatrix}1&0&0&0&0&0\\0&1&0&0&0&0\\0&0&1&0&0&0\end{bmatrix}\cdot W_{temp}^{l,k(m)},$$

with:

$$X_{21}=\sqrt{(\sigma_L^{l,m})^2(P_{R,L}^m)^2+(\sigma_{Ls}^{l,m})^2(P_{R,Ls}^m)^2}\cdot e^{-j(w_L^{l,m}\phi_L^m+w_{Ls}^{l,m}\phi_{Ls}^m)}\text{ and}$$

$$X_{12}=\sqrt{(\sigma_R^{l,m})^2(P_{L,R}^m)^2+(\sigma_{Rs}^{l,m})^2(P_{L,Rs}^m)^2}\cdot e^{-j(w_R^{l,m}\phi_R^m+w_{Rs}^{l,m}\phi_{Rs}^m)}$$

The matrix $H_D^{l,m}$ does not contain any term relating to the HRTF filtering coefficients. This matrix globally processes the operations for spatializing two channels (M=2) to five channels (N=5) and the operations for sub-mixing these five channels to two channels. In a particular embodiment in which a "Downmix" signal arising from the 5.0 signals to be coded is transported, the coefficients g, $w_j$, $\sigma_L^{l,m}$, $\sigma_{Ls}^{l,m}$, $\sigma_R^{l,m}$, $\sigma_R^{l,m}$ and $\sigma_{Rs}^{l,m}$ may be calculated by the coder so that this matrix approximates the unit matrix. Indeed, we must have:

$$\begin{bmatrix}\tilde{L}_0^{l,m}\\\tilde{R}_0^{l,m}\end{bmatrix}=H_D^{l,m}\begin{bmatrix}L_0^{l,m}\\R_0^{l,m}\end{bmatrix}$$

The matrix $H_{DBA}^{l,m}$ consists for its part in applying filterings based on contralateral HRTF functions deconvolved with ipsilateral functions. It will be noted that the involvement of a Downmix processing described hereinabove is a particular embodiment. The invention may also be implemented with other types of Downmix matrices.

Moreover, the embodiment introduced hereinabove is described by way of example. It is indeed apparent that it is not necessary, in practice, to seek to estimate the signals $L_0$ and $R_0$ by applying the matrix $H_D^{l,m}$ since these signals are transmitted from the coder to the decoder, to which these signals $\tilde{L}_0$ and $\tilde{R}_0$, and optionally the spatialization parameters, are indeed available, so as to reconstruct the signals for sound playback (optionally binaural if the decoder has indeed received the spatialization parameters). The latter embodiment exhibits two advantages. On the one hand, the number of processing procedures to be carried out to retrieve the signals $L_0$ and $R_0$ is thus reduced. On the other hand, the quality of the output signals is improved: passage to the transformed domain and return to the starting domain, as well as the application of the matrix $H_D^{l,m}$, necessarily degrade the signals. An advantageous embodiment therefore consists in applying the following processing:

$$\begin{bmatrix}\tilde{L}_B^{l,m}\\\tilde{R}_B^{l,m}\end{bmatrix}=\begin{bmatrix}L_0^{l,m}\\R_0^{l,m}\end{bmatrix}+H_{DBA}^{l,m}\begin{bmatrix}L_0^{l,m}\\R_0^{l,m}\end{bmatrix}$$

It is apparent moreover that the matrix $H_1^{l,m}$ can be further simplified. Indeed, returning to the expression:

$$H_1^{l,m}=\begin{bmatrix}h_{L,L}^{l,m}&h_{L,R}^{l,m}&h_{L,C}^{l,m}\\h_{R,L}^{l,m}&h_{R,R}^{l,m}&h_{R,C}^{l,m}\end{bmatrix}\cdot\begin{bmatrix}1&0&0&0&0&0\\0&1&0&0&0&0\\0&0&1&0&0&0\end{bmatrix}\cdot W_{temp}^{l,m},$$

it is possible to calculate the expressions for the five intermediate signals with the binaural Downmix processing as follows:

$$\tilde{L}^{l,m}=\sigma_L^{l,m}(w_{11}L_0^{l,m}+w_{12}R_0^{l,m})$$

$$\tilde{R}^{l,m}=\sigma_R^{l,m}(w_{12}L_0^{l,m}+w_{22}R_0^{l,m})$$

$$\tilde{C}^{l,m}=\sigma_C^{l,m}(w_{31}L_0^{l,m}+w_{32}R_0^{l,m})$$

$$\tilde{L}_s^{l,m}=\sigma_{L_s}^{l,m}(w_{11}L_0^{l,m}+w_{12}R_0^{l,m})$$

$$\tilde{R}_s^{l,m}=\sigma_{R_s}^{l,m}(w_{21}L_0^{l,m}+w_{22}R_0^{l,m})$$

Again with $P_{L,L}^m=P_{R,R}^m=P_{L,L_s}^m=P_{R,R}^m=1$, we obtain:

$$\tilde{L}_B^{l,m}=(\sigma_L^{l,m}(w_{11}L_0^{l,m}+w_{12}R_0^{l,m})+g\sigma_C^{l,m}(w_{31}L_0^{l,m}+w_{32}R_0^{l,m})+\sigma_{L_s}^{l,m}(w_{11}L_0^{l,m}+w_{12}R_0^{l,m}))+(\sigma_R^{l,m}(w_{21}L_0^{l,m})+g\sigma_C^{l,m}(w_{32}R_0^{l,m}))P_{L,R}^m\cdot e^{-j\phi_R^m}+\sigma_{R_s}^{l,m}(w_{21}L_0^{l,m}+w_{22}R_0^{l,m})P_{L,R_s}^m\cdot e^{-j\phi_{Rs}^m}$$

and $$\tilde{R}_B^{l,m}=(\sigma_R^{l,m}(w_{11}L_0^{l,m}+w_{12}R_0^{l,m})+g\sigma_C^{l,m}(w_{31}L_0^{l,m}+w_{32}R_0^{l,m})+\sigma_{R_s}^{l,m}(w_{11}L_0^{l,m}+w_{12}R_0^{l,m}))+(\sigma_L^{l,m}(w_{21}L_0^{l,m})+g\sigma_C^{l,m}(w_{32}R_0^{l,m}))P_{R,L}^m\cdot e^{-j\phi_L^m}+\sigma_{L_s}^{l,m}(w_{21}L_0^{l,m}+w_{22}R_0^{l,m})P_{R,L_s}^m\cdot e^{-j\phi_{Rs}^m}$$

Expanding these expressions, we find:

$$\tilde{L}_B^{l,m}=(\sigma_L^{l,m}w_{11}+g\sigma_C^{l,m}w_{31}+\sigma_{L_s}^{l,m}w_{11}+(\sigma_R^{l,m}w_{21}+g\sigma_C^{l,m}w_{31})P_{L,R}^m\cdot e^{-j\phi_R^m}+\sigma_{R_s}^{l,m}w_{21}P_{L,R_s}^m\cdot e^{-j\phi_{Rs}^m})L_0^{l,m}+(\sigma_L^{l,m}w_{12}+g\sigma_C^{l,m}w_{32}+\sigma_{L_s}^{l,m}w_{11}+(\sigma_R^{l,m}w_{21}+g\sigma_C^{l,m}w_{31})P_{L,R}^m\cdot e^{-j\phi_R^m}+\sigma_{R_s}^{l,m}w_{21}P_{L,R_s}^m\cdot e^{-j\phi_{Rs}^m})R_0^{l,m}$$

and $$\tilde{R}_B^{l,m}=(\sigma_R^{l,m}w_{11}+g\sigma_C^{l,m}w_{31}+\sigma_{R_s}^{l,m}w_{11}+(\sigma_L^{l,m}w_{21}+g\sigma_C^{l,m}w_{31})P_{R,L}^m\cdot e^{-j\phi_L^m}+\sigma_{R_s}^{l,m}w_{21}P_{L,R_s}^m\cdot e^{-j\phi_{Rs}^m})L_0^{l,m}+(\sigma_R^{l,m}w_{12}+g\sigma_C^{l,m}w_{32}+\sigma_{R_s}^{l,m}w_{11}+(\sigma_L^{l,m}w_{21}+g\sigma_C^{l,m}w_{31})P_{R,L}^m\cdot e^{-j\phi_L^m}+\sigma_{L_s}^{l,m}w_{21}P_{R,L_s}^m\cdot e^{-j\phi_{Rs}^m})R_0^{l,m}$$

These expressions are simplified with respect to their customary calculation. It is nonetheless possible, here again, to take the precaution not to lead to a cancellation of signals in phase opposition by seeking to preserve the energy levels of the various signals in the Downmix processing, as advocated hereinabove. We then obtain:

$$\tilde{L}_B^{l,m} = \left( \frac{\sqrt{(\sigma_L^{l,m} w_{11})^2 + (g\sigma_C^{l,m} w_{31})^2 + (\sigma_{L_s}^{l,m} w_{11})^2} +}{\sqrt{((\sigma_R^{l,m} w_{21})^2 + (g\sigma_C^{l,m} w_{31})^2) P_{L,R}^{n2} + (\sigma_{R_s}^{l,m} w_{21} P_{L,R_s}^{n})^2} \cdot e^{-j(w_R^{l,m} \phi_R^n + w_{R_s}^{l,m} \phi_{R_s}^n)}} \right) L_0^{l,m} +$$

$$\left( \frac{\sqrt{(\sigma_L^{l,m} w_{12})^2 + (g\sigma_C^{l,m} w_{32})^2 + (\sigma_{L_s}^{l,m} w_{12})^2} +}{\sqrt{((\sigma_R^{l,m} w_{22})^2 + (g\sigma_C^{l,m} w_{32})^2) P_{L,R}^{n2} + (\sigma_{R_s}^{l,m} w_{22} P_{L,R_s}^{n})^2} \cdot e^{-j(w_R^{l,m} \phi_R^n + w_{R_s}^{l,m} \phi_{R_s}^n)}} \right) R_0^{l,m}$$

$$\tilde{R}_B^{l,m} = \left( \frac{\sqrt{(\sigma_R^{l,m} w_{21})^2 + (g\sigma_C^{l,m} w_{31})^2 + (\sigma_{R_s}^{l,m} w_{21})^2} +}{\sqrt{((\sigma_L^{l,m} w_{11})^2 + (g\sigma_C^{l,m} w_{31})^2) P_{R,L}^{n2} + (\sigma_{L_s}^{l,m} w_{11} P_{R,L_s}^{n})^2} \, e^{-j(w_L^{l,m} \phi_L^n + w_{L_s}^{l,m} \phi_{L_s}^n)}} \right) L_0^{l,m} +$$

$$\left( \frac{\sqrt{(\sigma_R^{l,m} w_{22})^2 + (g\sigma_C^{l,m} w_{32})^2 + (\sigma_{R_s}^{l,m} w_{22})^2} +}{\sqrt{((\sigma_L^{l,m} w_{12})^2 + (g\sigma_C^{l,m} w_{32})^2) P_{R,L}^{n2} + (\sigma_{L_s}^{l,m} w_{12} P_{R,L_s}^{n})^2} \, e^{-j(w_L^{l,m} \phi_L^n + w_{L_s}^{l,m} \phi_{L_s}^n)}} \right) R_0^{l,m}$$

with:

$$w_L^{l,m} = \frac{((\sigma_L^{l,m} w_{11})^2 + (g\sigma_C^{l,m} w_{31})^2) P_{R,L}^{n2}}{((\sigma_L^{l,m} w_{11})^2 + (g\sigma_C^{l,m} w_{31})^2) P_{R,L}^{n2} + (\sigma_{L_s}^{l,m} w_{11} P_{R,L_s}^{n})^2}$$

$$w_{L_s}^{l,m} = \frac{(\sigma_{L_s}^{l,m} w_{11} P_{R,L_s}^{n})^2}{((\sigma_L^{l,m} w_{11})^2 + (g\sigma_C^{l,m} w_{31})^2) P_{R,L}^{n2} + (\sigma_{L_s}^{l,m} w_{11} P_{R,L_s}^{n})^2}$$

$$w_L'^{l,m} = \frac{((\sigma_L^{l,m} w_{12})^2 + (g\sigma_C^{l,m} w_{32})^2) P_{R,L}^{n2}}{((\sigma_L^{l,m} w_{12})^2 + (g\sigma_C^{l,m} w_{32})^2) P_{R,L}^{n2} + (\sigma_{L_s}^{l,m} w_{12} P_{R,L_s}^{n})^2}$$

$$w_{L_s}'^{l,m} = \frac{(\sigma_{L_s}^{l,m} w_{12} P_{R,L_s}^{n})^2}{((\sigma_L^{l,m} w_{12})^2 + (g\sigma_C^{l,m} w_{32})^2) P_{R,L}^{n2} + (\sigma_{L_s}^{l,m} w_{12} P_{R,L_s}^{n})^2}$$

$$w_R^{l,m} = \frac{((\sigma_R^{l,m} w_{21})^2 + (g\sigma_C^{l,m} w_{31})^2) P_{L,R}^{n2}}{((\sigma_R^{l,m} w_{21})^2 + (g\sigma_C^{l,m} w_{31})^2) P_{L,R}^{n2} + (\sigma_{R_s}^{l,m} w_{21} P_{L,R_s}^{n})^2}$$

$$w_{R_s}^{l,m} = \frac{(\sigma_{R_s}^{l,m} w_{21} P_{L,R_s}^{n})^2}{((\sigma_R^{l,m} w_{21})^2 + (g\sigma_C^{l,m} w_{31})^2) P_{L,R}^{n2} + (\sigma_{R_s}^{l,m} w_{21} P_{L,R_s}^{n})^2}$$

$$w_R'^{l,m} = \frac{((\sigma_R^{l,m} w_{22})^2 + (g\sigma_C^{l,m} w_{32})^2) P_{L,R}^{n2}}{((\sigma_R^{l,m} w_{22})^2 + (g\sigma_C^{l,m} w_{32})^2) P_{L,R}^{n2} + (\sigma_{R_s}^{l,m} w_{22} P_{L,R_s}^{n})^2}$$

$$w_{R_s}'^{l,m} = \frac{(\sigma_{R_s}^{l,m} w_{22} P_{L,R_s}^{n})^2}{((\sigma_R^{l,m} w_{22})^2 + (g\sigma_C^{l,m} w_{32})^2) P_{L,R}^{n2} + (\sigma_{R_s}^{l,m} w_{22} P_{L,R_s}^{n})^2}$$

The expression for the matrix $H_1^{l,m}$ is then as follows:

$$H_1^{l,m} = \begin{bmatrix} \sqrt{(\sigma_L^{l,m} w_{11})^2 + (g\sigma_C^{l,m} w_{31})^2 + (\sigma_{Ls}^{l,m} w_{11})^2} + \sqrt{((\sigma_R^{l,m} w_{21})^2 + (g\sigma_C^{l,m} w_{31})^2) P_{L,R}^{m2} + (\sigma_{Rs}^{l,m} w_{21} P_{L,Rs}^{m})^2} \cdot e^{-j(w_R^{l,m} \phi_R^m + w_{Rs}^{l,m} \phi_{Rs}^m)} & \sqrt{(\sigma_L^{l,m} w_{12})^2 + (g\sigma_C^{l,m} w_{32})^2 + (\sigma_{Ls}^{l,m} w_{12})^2} + \sqrt{((\sigma_R^{l,m} w_{22})^2 + (g\sigma_C^{l,m} w_{32})^2) P_{L,R}^{m2} + (\sigma_{Rs}^{l,m} w_{22} P_{L,Rs}^{m})^2} \cdot e^{-j(w'^{l,m}_R \phi_R^m + w'^{l,m}_{Rs} \phi_{Rs}^m)} \\ \sqrt{(\sigma_R^{l,m} w_{21})^2 + (g\sigma_C^{l,m} w_{31})^2 + (\sigma_{Rs}^{l,m} w_{21})^2} + \sqrt{((\sigma_L^{l,m} w_{11})^2 + (g\sigma_C^{l,m} w_{31})^2) P_{R,L}^{m2} + (\sigma_{Ls}^{l,m} w_{11} P_{R,Ls}^{m})^2} \cdot e^{-j(w_L^{l,m} \phi_{Ls}^m + w_{Ls}^{l,m} \phi_{Ls}^m)} & \sqrt{(\sigma_R^{l,m} w_{22})^2 + (g\sigma_C^{l,m} w_{32})^2 + (\sigma_{Rs}^{l,m} w_{22})^2} + \sqrt{((\sigma_L^{l,m} w_{12})^2 + (g\sigma_C^{l,m} w_{32})^2) P_{R,L}^{m2} + (\sigma_{Ls}^{l,m} w_{12} P_{R,Ls}^{m})^2} \cdot e^{-j(w'^{l,m}_L \phi_L^m + w'^{l,m}_{Ls} \phi_{Ls}^m)} \end{bmatrix}$$

Of course, the present invention is not limited to the embodiment described hereinabove by way of example; it extends to other variants.

Thus, described hereinabove is the case of a processing of two initial stereo signals to be encoded and spatialized to binaural stereo, passing via a 5.1 spatialization. Nonetheless, the invention applies moreover to the processing of an initial mono signal (case where N=1 in the general expression N>0 given hereinabove and applying to the number of initial channels to be processed). Returning for example to the case of the standard "*Information technology—MPEG audio technologies—Part* 1: *MPEG Surround*", ISO/BEC JTC 1/SC 29 (21 Jul. 2006), the equations exhibited in point 6.11.4.1.3.1, for the case of a first processing of the type mono—5.1 spatialization—binauralization (denoted "5-1-$5_i$" and consisting in processing from the outset the surround tracks before the central track), simplify to:

$$\begin{aligned}
(\sigma_L^{l,m})^2 &= (\sigma_L^{l,m})^2 + (\sigma_C^{l,m} g)^2 + (\sigma_{Ls}^{l,m})^2 + (P_{L,R}^{l,m})^2((\sigma_R^{l,m})^2 + (\sigma_C^{l,m} g)^2) + (P_{L,Rs}^{l,m})^2 (\sigma_{Rs}^{l,m})^2 + \ldots \\
&\quad 2P_{L,R}^{l,m}\rho_R^m(\sigma_L^{l,m}\sigma_R^{l,m} ICC_3^{l,m} + (\sigma_C^{l,m} g)^2)\cos(\phi_R^m) + \ldots \\
&\quad 2P_{L,Rs}^{l,m}\rho_{Rs}^m\sigma_{Ls}^{l,m}\sigma_{Rs}^{l,m} ICC_2^{l,m}\cos(\phi_{Rs}^m) \\
(\sigma_R^{l,m})^2 &= (P_{R,L}^{l,m})^2((\sigma_L^{l,m})^2 + (\sigma_C^{l,m} g)^2) + (\sigma_C^{l,m} g)^2 + (P_{R,Ls}^{l,m})^2 (\sigma_{Ls}^{l,m})^2 + (\sigma_R^{l,m})^2 + (\sigma_{Rs}^{l,m})^2 + \ldots \\
&\quad 2P_{R,L}^{l,m}\rho_L^m(\sigma_L^{l,m}\sigma_R^{l,m} ICC_3^{l,m} + (\sigma_C^{l,m} g)^2)\cos(\phi_L^m) + \ldots \\
&\quad 2P_{R,Ls}^{l,m}\rho_{Ls}^m\sigma_{Ls}^{l,m}\sigma_{Rs}^{l,m} ICC_2^{l,m}\cos(\phi_{Ls}^m)
\end{aligned}$$

and $$\begin{aligned}
\langle L_B R_B^* \rangle^{l,m} &= ((\sigma_L^{l,m})^2 + (g\sigma_C^{l,m})^2) P_{R,L}^{l,m}\rho_L^m \exp(j\phi_L) + \ldots \\
&\quad ((\sigma_R^{l,m})^2 + (g\sigma_C^{l,m})^2) P_{L,R}^{l,m}\rho_R^m \exp(j\phi_R) + \ldots \\
&\quad (\sigma_{Ls}^{l,m})^2 P_{R,Ls}^{l,m}\rho_C^m \exp(j\phi_{Ls}) + \ldots \\
&\quad (\sigma_{Rs}^{l,m})^2 P_{L,Rs}^{l,m}\rho_{Rs}^m \exp(j\phi_{Rs}) + \ldots \\
&\quad (\sigma_L^{l,m}\sigma_R^{l,m} ICC_3^{l,m} + (g\sigma_C^{l,m})^2) + \ldots \\
&\quad \sigma_{Ls}^{l,m}\sigma_{Rs}^{l,m} ICC_2^{l,m} + \ldots \\
&\quad P_{L,R}^{l,m} P_{R,L}^{l,m}(\sigma_L^{l,m}\sigma_R^{l,m} ICC_3^{l,m} + (g\sigma_C^{l,m})^2)\rho_L^m\rho_R^m \exp(j(\phi_R^m + \phi_L^m)) + \ldots \\
&\quad P_{L,Rs}^{l,m} P_{R,Ls}^{l,m}\sigma_{Ls}^{l,m}\sigma_{Rs}^{l,m} ICC_3^{l,m}\rho_{Ls}^m\rho_{Rs}^m \exp(j(\phi_{Rs}^m + \phi_{Ls}^m))
\end{aligned}$$

Likewise, the equations presented in point 6.11.4.1.3.2, for the case of a first processing of the type mono—5.1 spatialization—binauralization (denoted "5-1-$5_2$" and consisting in processing from the outset the central track, and then in processing the surround effect on each track, left and right), simplify to:

$$\begin{aligned}
(\sigma_L^{l,m})^2 &= (\sigma_L^{l,m})^2 + (\sigma_C^{l,m} g)^2 + (\sigma_{Ls}^{l,m})^2 + (P_{L,R}^{l,m})^2((\sigma_R^{l,m})^2 + (\sigma_C^{l,m} g)^2) + (P_{L,Rs}^{l,m})^2 + \ldots \\
&\quad 2P_{L,R}^{l,m}\rho_R^m(\sigma_L^{l,m}\sigma_R^{l,m} ICC_1^{l,m} + (\sigma_C^{l,m} g)^2)\cos(\phi_R^m) + \ldots \\
&\quad 2P_{L,Rs}^{l,m}\rho_{Rs}^m\sigma_{Ls}^{l,m}\sigma_1^{l,m}\cos(\phi_{Rs}^m) \\
(\sigma_R^{l,m})^2 &= (P_{R,L}^{l,m})^2((\sigma_L^{l,m})^2 + (\sigma_C^{l,m} g)^2) + (\sigma_C^{l,m} g)^2 + (P_{R,Ls}^{l,m})^2(\sigma_{Ls}^{l,m})^2 + (\sigma_R^{l,m})^2 + (\sigma_{Rs}^{l,m})^2 + \ldots \\
&\quad 2P_{R,L}^{l,m}\rho_L^m(\sigma_L^{l,m}\sigma_R^{l,m} ICC_1^{l,m} + (\sigma_C^{l,m} g)^2)\cos(\phi_L^m) + \ldots \\
&\quad 2P_{R,Ls}^{l,m}\rho_{Ls}^m\sigma_{Ls}^{l,m}\sigma_{Rs}^{l,m} ICC_1^{l,m}\cos(\phi_{Ls}^m)
\end{aligned}$$

and $$\begin{aligned}
\langle L_B R_B^* \rangle^{l,m} &= ((\sigma_L^{l,m})^2 + (g\sigma_C^{l,m})^2) P_{R,L}^{l,m}\rho_L^m \exp(j\phi_L) + \ldots \\
&\quad ((\sigma_R^{l,m})^2 + (g\sigma_C^{l,m})^2) P_{L,R}^{l,m}\rho_R^m \exp(j\phi_R) + \ldots \\
&\quad (\sigma_{Ls}^{l,m})^2 P_{R,Ls}^{l,m}\rho_C^m \exp(j\phi_{Ls}) + \ldots \\
&\quad (\sigma_{Rs}^{l,m})^2 P_{L,Rs}^{l,m}\rho_{Rs}^m \exp(j\phi_{Rs}) + \ldots \\
&\quad (\sigma_L^{l,m}\sigma_R^{l,m} ICC_3^{l,m} + (g\sigma_C^{l,m})^2) + \ldots \\
&\quad \sigma_{Ls}^{l,m}\sigma_{Rs}^{l,m} ICC_1^{l,m} + \ldots \\
&\quad P_{L,R}^{l,m} P_{R,L}^{l,m}(\sigma_L^{l,m}\sigma_R^{l,m} ICC_1^{l,m} + (g\sigma_C^{l,m})^2)\rho_L^m\rho_R^m \exp(j(\phi_R^m + \phi_L^m)) + \ldots \\
&\quad P_{L,Rs}^{l,m} P_{R,Ls}^{l,m}\sigma_{Ls}^{l,m}\sigma_{Rs}^{l,m} ICC_1^{l,m}\rho_{Ls}^m\rho_{Rs}^m \exp(j(\phi_{Rs}^m + \phi_{Ls}^m))
\end{aligned}$$

More generally, provision may be made for other processing procedures of the signals or of components of signals intended to be played back in binaural or transaural format. For example, the tracks $S_G$ and $S_D$ of FIG. 4B can furthermore undergo a dynamic low-pass filtering of Dolby® type or the like.

The present invention is also aimed at a module MOD (FIG. 4B) for processing sound data, for passing from a multi-channel format to a binaural or transaural format, in the transformed domain, whose elements could be those illustrated in FIG. 4B. Such a module then comprises processing means, such as a processor PROC and a work memory MEM, for the implementation of the invention. It may be built into any type of decoder, in particular of a device for sound playback (PC computer, personal stereo, mobile telephone, or the like) and optionally for film viewing. As a variant, the module may be designed to operate separately from the playback, for example to prepare contents in the binaural or transaural format, with a view to subsequent decoding.

The present invention is also aimed at a computer program, downloadable via a telecommunication network and/or stored in a memory of a processing module of the aforementioned type and/or stored on a memory medium intended to cooperate with a reader of such a processing module, and comprising instructions for the implementation of the invention, when they are executed by a processor of said module.

The invention claimed is:

1. A method for processing sound data encoded in a sub-band domain, for dual-channel playback of binaural or Transaural® type, wherein a matrix filtering is applied so as to pass from a sound representation with N channels with N>0, to a dual-channel representation, said sound representation with N channels consisting in considering N virtual loudspeakers surrounding the head of a listener, and, for each virtual loudspeaker of at least some of the loudspeakers:

a first transfer function specific to an ipsilateral path from the loudspeaker to a first ear of the listener, facing the loudspeaker, and a second transfer function specific to a contralateral path from said loudspeaker to the second ear of the listener, masked from the loudspeaker by the listener's head, the matrix filtering applied comprising a multiplicative coefficient defined by the spectrum, in the sub-band domain, of the second transfer function deconvolved with the first transfer function, wherein a matrix filtering is applied so as to pass from a sound representation with M channels, with M>0, to a dual-channel representation, by passing through an intermediate representation on said N channels, with N>2, and wherein the coefficients of the matrix are expressed, for a contralateral path, at least as a function of respective spatialization gains of the M channels on the N virtual loudspeakers situated in a hemisphere around a first ear, and of the spectra of the contralateral transfer function, relating to the second ear of the listener, deconvolved with the ipsilateral transfer function, relating to the first ear, while, for an ipsilateral path, the coefficients of the matrix are expressed as a function of spatialization gains of the M channels on the N virtual loudspeakers situated in a hemisphere around a first ear, and wherein the representation with N channels comprises, per hemisphere around an ear, at least one direct virtual loudspeaker and one ambience virtual loudspeaker, the coefficients of the matrix being expressed, in a sub-band domain as time-frequency transform, by:

$h_{L,C}^{l,m}=g(1+P_{L,R}^{m}\cdot e^{-j\Phi_R^m})$, for the paths from a central virtual loudspeaker to the left ear, $h_{R,C}^{l,m}=g(1+P_{R,L}^{m}\cdot e^{-j\Phi_L^m})$, for the paths from a central virtual loudspeaker to the right ear, $$h_{L,R}^{l,m} = e^{j(w_R^{l,m} d_R^m + w_{Rs}^{l,m} d_{Rs}^m)} \sqrt{(\sigma_R^{l,m})^2 (P_{L,R}^m)^2 + (\sigma_{Rs}^{l,m})^2 (P_{L,Rs}^m)^2},$$

for the contralateral paths to the left ear;

$$h_{R,L}^{l,m} = e^{-j(w_L^{l,m} d_L^m + w_{Ls}^{l,m} d_{Ls}^m)} \sqrt{(\sigma_L^{l,m})^2 (P_{R,L}^m)^2 + (\sigma_{Ls}^{l,m})^2 (P_{R,Ls}^m)^2},$$

for the contralateral paths to the right ear;

$h_{L,L}^{l,m}=\sqrt{(\sigma_L^{l,m})^2+(\sigma_{Ls}^{lm})^2}$, for the ipsilateral paths to the left ear;

$h_{R,R}^{l,m}=\sqrt{(\sigma_L^{l,m})^2+(\sigma_{Ls}^{lm})^2}$, for the ipsilateral paths to the right ear;

where:

g is a mixing apportionment gain from a central virtual loudspeaker channel to left and right direct loudspeaker channels, $\sigma_L^{l,m}$ and $\sigma_{Ls}^{l,m}$ represent relative gains to be applied to one and the same first signal so as to define channels L and Ls respectively of the left direct and left ambience virtual loudspeakers, for sample l of frequency band m in time-frequency transform, $\sigma_R^{l,m}$ or $\sigma_{Rs}^{l,m}$ represent relative gains to be applied to one and the same second signal so as to define channels R and Rs of the right direct and right ambience virtual loudspeakers, for sample l of frequency band m in time-frequency transform, $P_{R,L}^m$ or $P_{R,Ls}^m$ is the expression for the spectrum of the transfer function of contralateral HRTF type, relating to the right ear of the listener, deconvolved with an ipsilateral transfer function, relating to the left ear, for a direct or respectively ambience, left virtual loudspeaker, $P_{L,R}^m$ or $P_{L,Rs}^m$ is the expression for the spectrum of the transfer function of contralateral HRTF type, relating to the left ear of the listener, deconvolved with an ipsilateral transfer function, relating to the right ear, for a direct or respectively ambience, right virtual loudspeaker, $\phi_L^m$, $\phi_{Ls}^m$, $\phi_R^m$ and $\phi_{Rs}^m$ are phase shifts between contralateral and ipsilateral transfer functions corresponding to chosen interaural delays, and $w_L^{l,m}$, $w_{Ls}^{l,m}$, $w_R^{l,m}$ and $w_{Rs}^{l,m}$ are chosen weightings.

2. The method as claimed in claim 1, wherein the coefficients of the matrix vary as a function of frequency, according to a weighting of a chosen factor less than one, if the frequency is less than a chosen threshold, and of one otherwise.

3. The method as claimed in claim 2, wherein the factor is about 0.5 and the chosen frequency threshold is about 500 Hz so as to eliminate a coloration distortion.

4. The method as claimed in claim 1, wherein a chosen gain is furthermore applied to two signals, left track and right track, in dual-channel representation, before playback, the chosen gain being controlled so as to limit an energy of the left track and right track signals, to the maximum, to an energy of signals of the virtual loudspeakers.

5. The method as claimed in claim 4, wherein the coefficients of the matrix vary as a function of frequency, according to a weighting of a chosen factor less than one, if the frequency is less than a chosen threshold, and of one otherwise, and wherein an automatic gain control is applied to the two signals, left track and right track, downstream of the application of the frequency-variable weighting factor.

6. The method as claimed in claim 1, wherein the matrix filtering is expressed according to a product of matrices of type:

$$H_1^{l,k} = \begin{bmatrix} h_{L,L}^{l,m} & h_{L,R}^{l,m} & h_{L,C}^{l,m} \\ h_{R,L}^{l,m} & h_{R,R}^{l,m} & h_{R,C}^{l,m} \end{bmatrix} \cdot \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot W_{temp}^{l,\kappa(k)},$$

$$0 \le k < K,\ 0 \le l < L,$$

where:

$W^{l,m}$ represents a processing matrix for expanding stereo signals to M' channels, with M'>2, and $$\begin{bmatrix} h_{L,L}^{l,m} & h_{L,R}^{l,m} & h_{L,C}^{l,m} \\ h_{R,L}^{l,m} & h_{R,R}^{l,m} & h_{R,C}^{l,m} \end{bmatrix} \cdot \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix}$$

represents a global matrix processing comprising:

a processing for expanding M' channels to said N channels, with N>3, and a process for spatializing the N virtual loudspeakers respectively associated with the N channels so as to obtain a binaural or Transaural®, dual-channel representation, with:

$$h_{L,C}^{l,m} = g(1+P_{R,L}^{m} \cdot e^{-j\phi_L^m}),\ h_{R,C}^{l,m} = g(1+P_{R,L}^{m} \cdot e^{-j\phi_L^m}),$$

$$h_{L,R}^{l,m} = e^{j(w_R^{l,m} d_R^m + w_{Rs}^{l,m} d_{Rs}^m)} \sqrt{(\sigma_R^{l,m})^2 (P_{L,R}^m)^2 + (\sigma_{Rs}^{l,m})^2 (P_{L,Rs}^m)^2},$$

$$h_{R,L}^{l,m} = e^{-j(w_L^{l,m} d_L^m + w_{Ls}^{l,m} d_{Ls}^m)} \sqrt{(\sigma_L^{l,m})^2 (P_{R,L}^m)^2 + (\sigma_{Ls}^{l,m})^2 (P_{R,Ls}^m)^2},$$

$h_{L,L}^{l,m} = \sqrt{(\sigma_L^{l,m})^2 + (\sigma_{Ls}^{lm})^2}$ and $h_{R,R}^{l,m} = \sqrt{(\sigma_R^{l,m})^2 + (\sigma_{Ls}^{lm})^2}$.

7. The method as claimed in claim 1, wherein the matrix filtering consists in applying:

a first processing for sub-mixing the N channels to two stereo signals, and a second processing leading, when it is executed jointly with the first processing, to a spatialization of the N virtual loudspeakers respectively associated with the N channels so as to obtain a binaural or Transaural®, dual-channel representation.

8. The method as claimed in claim 7, wherein a weighting of the second processing in said matrix filtering is chosen.

9. The method as claimed in claim 8, wherein the first processing is applied in a coder communicating with a decoder, and the second processing is applied in said decoder.

10. The method as claimed in claim 6, wherein the matrix filtering consists in applying:

a first processing for sub-mixing the N channels to two stereo signals, and a second processing leading, when it is executed jointly with the first processing, to a spatialization of the N virtual loudspeakers respectively associated with the N channels so as to obtain a binaural or Transaural®, dual-channel representation, and wherein the matrix:

$$H_1^{l,k} = \begin{bmatrix} h_{L,L}^{l,m} & h_{L,R}^{l,m} & h_{L,C}^{l,m} \\ h_{R,L}^{l,m} & h_{R,R}^{l,m} & h_{R,C}^{l,m} \end{bmatrix} \cdot \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot W_{temp}^{l,\kappa(k)},$$

is written as a sum of matrices $H_1^{l,m} = H_D^{l,m} + H_{ABD}^{l,m}$, with:

a first matrix representing the first processing being expressed by:

$$H_D^{l,m} = \begin{bmatrix} \sqrt{(\sigma_L^{l,m})^2 + (\sigma_{Ls}^{l,m})^2} & 0 & g \\ 0 & \sqrt{(\sigma_R^{l,m})^2 + (\sigma_{Rs}^{l,m})^2} & g \end{bmatrix} \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot W_{temp}^{l,\kappa(k)}$$

and a second matrix representing the second processing being expressed by:

$$H_{ABD}^{l,m} = \begin{bmatrix} 0 & X_{12} & gP_{L,R}^n e^{-j\phi_R} \\ X_{21} & 0 & gP_{R,L}^n e^{-j\phi_L} \end{bmatrix} \cdot \begin{bmatrix} 1 & 0 & 0 & 0 & 0 & 0 \\ 0 & 1 & 0 & 0 & 0 & 0 \\ 0 & 0 & 1 & 0 & 0 & 0 \end{bmatrix} \cdot W_{temp}^{l,\kappa(m)},$$

with $$X_{21} = \sqrt{(\sigma_L^{l,m})^2 (P_{R,L}^n)^2 + (\sigma_{Ls}^{l,m})^2 (P_{R,Ls}^n)^2} \cdot e^{-j(w_L^{l,m} d_L^m + w_{Ls}^{l,m} d_{Ls}^m)}$$

and $$X_{12} = \sqrt{(\sigma_R^{l,m})^2 (P_{L,R}^n)^2 + (\sigma_{Rs}^{l,m})^2 (P_{L,Rs}^n)^2} \cdot e^{-j(w_R^{l,m} d_R^m + w_{Rs}^{l,m} d_{Rs}^m)}.$$

11. A non-transitory computer program product comprising instructions for the implementation of the method as claimed in claim 1, when this program is executed by a processor.

12. A module for processing sound data encoded in a sub-band domain, for dual-channel playback of binaural or Transaural® type, the module comprising means for applying a matrix filtering so as to pass from a sound representation with N channels with N>0, to a dual-channel representation, said sound representation with N channels consisting in considering N virtual loudspeakers surrounding the head of a listener, and, for each virtual loudspeaker of at least some of the loudspeakers:

a first transfer function specific to an ipsilateral path from the loudspeaker to a first ear of the listener, facing the loudspeaker, and a second transfer function specific to a contralateral path from said loudspeaker to the second ear of the listener, masked from the loudspeaker by the listener's head, the matrix filtering applied comprising a multiplicative coefficient defined by the spectrum, in the sub-band domain, of the second transfer function deconvolved with the first transfer function, and the module further comprising means for applying a matrix filtering so as to pass from a sound representation with M channels, with M>0, to a dual-channel representation, by passing through an intermediate representation on said N channels, with N>2, and wherein the coefficients of the matrix are expressed, for a contralateral path, at least as a function of respective spatialization gains of the M channels on the N virtual loudspeakers situated in a hemisphere around a first ear, and of the spectra of the contralateral transfer function, relating to the second ear of the listener, deconvolved with the ipsilateral transfer function, relating to the first ear, while, for an ipsilateral path, the coefficients of the matrix are expressed as a function of spatialization gains of the M channels on the N virtual loudspeakers situated in a hemisphere around a first ear, and wherein the representation with N channels comprises, per hemisphere around an ear, at least one direct virtual loudspeaker and one ambience virtual loudspeaker, the coefficients of the matrix being expressed, in a sub-band domain as time-frequency transform, by:

$h_{L,C}^{l,m}=g(1+P_{L,R}^{m}\cdot e^{-j\phi_R^m})$, for the paths from a central virtual loudspeaker to the left ear, $h_{R,C}^{l,m}=g(1+P_{L,R}^{m}\cdot e^{-j\phi_R^m})$, for the paths from a central virtual loudspeaker to the right ear, $$h_{L,R}^{l,m}e^{j(w_R^{l,m}\phi_R^m+w_{Rs}^{l,m}\phi_{Rs}^m)}\sqrt{(\sigma_R^{l,m})^2(P_{L,R}^m)^2+(\sigma_{Rs}^{l,m})^2(P_{L,Rs}^m)^2},$$

for the contralateral paths to the left ear;

$$h_{L,R}^{l,m}e^{-j(w_L^{l,m}\phi_L^m+w_{Ls}^{l,m}\phi_{Ls}^m)}\sqrt{(\sigma_L^{l,m})^2(P_{R,L}^m)^2+(\sigma_{Ls}^{l,m})^2(P_{R,Ls}^m)^2},$$

for the contralateral paths to the right ear;

$h_{L,L}^{l,m}=\sqrt{(\sigma_L^{l,m})^2+(\sigma_{Ls}^{lm})^2}$, for the ipsilateral paths to the left ear;

$h_{R,R}^{l,m}=\sqrt{(\sigma_R^{l,m})^2+(\sigma_{Rs}^{lm})^2}$, for the ipsilateral paths to the right ear;

where:

g is a mixing apportionment gain from a central virtual loudspeaker channel to left and right direct loudspeaker channels, $\sigma_L^{l,m}$ and $\sigma_{Ls}^{l,m}$ represent relative gains to be applied to one and the same first signal so as to define channels L and Ls respectively of the left direct and left ambience virtual loudspeakers, for sample l of frequency band m in time-frequency transform, $\sigma_R^{l,m}$ or $\sigma_{Rs}^{l,m}$ represent relative gains to be applied to one and the same second signal so as to define channels R and Rs of the right direct and right ambience virtual loudspeakers, for sample l of frequency band m in time-frequency transform, $P_{R,L}^m$ or $P_{R,Ls}^m$ is the expression for the spectrum of the transfer function of contralateral HRTF type, relating to the right ear of the listener, deconvolved with an ipsilateral transfer function, relating to the left ear, for a direct or respectively ambience, left virtual loudspeaker, $P_{L,R}^m$ or $P_{L,Rs}^m$ is the expression for the spectrum of the transfer function of contralateral HRTF type, relating to the left ear of the listener, deconvolved with an ipsilateral transfer function, relating to the right ear, for a direct or respectively ambience, right virtual loudspeaker, $\phi_L^m$, $\phi_{Ls}^m$, $\phi_R^m$ and $\phi_{Rs}^m$ are phase shifts between contralateral and ipsilateral transfer functions corresponding to chosen interaural delays, and $w_L^{l,m}$, $w_{Ls}^{l,m}$, $w_R^{l,m}$ and $w_{Rs}^{l,m}$ are chosen weightings.

13. The module as claimed in claim 12, further comprising decoding means of MPEG Surround® type.

* * * * *